US005558146A

United States Patent [19]

Abe

[11] Patent Number: 5,558,146

[45] Date of Patent: Sep. 24, 1996

[54] BLIND

[76] Inventor: Makio Abe, 2-1-82-204, Sakurazutsumi, Musashino-shi,Tokyo, 180, Japan

[21] Appl. No.: 256,852

[22] PCT Filed: Nov. 25, 1993

[86] PCT No.: PCT/JP93/01728

§ 371 Date: Jul. 26, 1994

§ 102(e) Date: Jul. 26, 1994

[87] PCT Pub. No.: WO94/12755

PCT Pub. Date: Jun. 9, 1994

[30] Foreign Application Priority Data

Nov. 26, 1992 [JP] Japan ..... 4-337792

[51] Int. Cl.[6] ..... E06B 9/26

[52] U.S. Cl. ..... 160/176.1; 160/236

[58] Field of Search ..... 160/236, 174 R, 160/176.1 R, 177 R, 178.1 R; 40/497, 503

[56] References Cited

U.S. PATENT DOCUMENTS

| | | | |
|---|---|---|---|
| 2,121,217 | 6/1938 | Ellis | 160/236 |
| 4,139,043 | 2/1979 | Donofrio | 160/236 |
| 4,382,460 | 5/1983 | Ben-Tal | 160/236 |
| 5,029,413 | 7/1991 | Jovanovic | 160/236 X |
| 5,209,282 | 5/1993 | Franco et al. | 160/236 |

FOREIGN PATENT DOCUMENTS

| | | |
|---|---|---|
| 58-118197 | 8/1983 | Japan . |
| 60-35898 | 3/1985 | Japan . |
| 64-83795 | 3/1989 | Japan . |
| 3-96591 | 4/1991 | Japan . |

*Primary Examiner*—Blair Johnson
*Attorney, Agent, or Firm*—Lowe, Price, LeBlanc & Becker

[57] ABSTRACT

A number of parallel slats (3) of a blind (1) comprise transparent base boards (3*a*), and graphic pattern forming regions (16) are provided on the respective slats (3) by a paint or the like. When the slats (3) are simultaneously tilted at a predetermined angle, the graphic pattern forming regions (16) on the respective slats (3) are combined with each other to block the light coming from behind the blind (1) or reflect the light coming from behind from the side of the observer, thereby producing a significant graphic pattern (18) such as a portrait on a blind surface (17). The significant graphic pattern (18) can be recognized when the observer views the blind surface (17) or the shadow projected onto a wall or floor. The significant graphic pattern (18) creates an excellent interior atmosphere.

22 Claims, 15 Drawing Sheets

BLIND

TECHNICAL FIELD

The present invention relates to a blind for use as an interior article having an element for providing an excellent interior atmosphere.

BACKGROUND ART

Blinds originally serve the purpose of adjusting or blocking the rays of light which are introduced through a building opening into an interior. To meet a demand for a comfortable residential space, blinds are also required to have an element for providing a better interior atmosphere as well as the functions to adjust and block the light. Thus, various ideas have been put to practice in such a way as reducing the width of slates for giving a light visual impression or coloring the slats with soft quiet hues, but all such efforts have not brought satisfactory results.

With presently available blinds, much importance is attached to the functions to adjust and block the light, and slats are made of light-shielding materials such as a light alloy. Therefore, even if slats have soft colors, they look dark as long as viewed from the interior space in the daytime, thereby reducing the effect of the intended interior atmosphere.

Furthermore, conventional blinds are utterly lacking in any technical idea for positively utilizing daylight to provide an excellent atmosphere in the interior space. The applicant has proposed in Japanese patent application No. 62-239948 (Japanese laid-open patent publication No. 64-83795) a blind which positively utilizes daylight to provide an excellent atmosphere in the interior space, without impairing the original functions of the blind to adjust and block the light.

The proposed blind has parallel slats angularly movable simultaneously about their own longitudinal axes, each slat having a graphic pattern forming region on a base board of transparent material. The base board has, in its cross section perpendicular to the longitudinal axis thereof, a central surface, a first bent surface bent obliquely upward from one edge of the central surface, and a second bent surface bent obliquely downward from the other edge. When the slats are angularly moved and tilted at a predetermined angle, the graphic pattern forming regions of the respective slats are combined with each other to produce a significant graphic pattern for an observer on the entire blind.

The graphic pattern forming region is a region formed of a light-shielding paint or film, and the significant graphic pattern is a graphic pattern which is formed on the entire blind when the graphic pattern forming regions of individual slats are combined to give the observer in the interior space some impression through the visual sensation. Such graphic patterns include a pattern formed by the projected light from behind the blind onto the floor or wall (projection type), and a pattern formed on the entire blind by the reflected light from graphic pattern forming regions (direct-type) direct viewing type.

However, the above proposed blind has the following problems to be solved:

When the significant graphic pattern produced by the graphic pattern forming regions on the base boards of the slats has disappeared as the blind is closed, an insignificant pattern, or a pattern which may be uncomfortable to some people, may be formed by the graphic pattern forming regions, making the interior atmosphere uncomfortable rather than improving it.

Since the graphic pattern forming regions are fixed to the slat base boards, when the user is bored with the significant graphic pattern which is produced, the user has no choice other than replacing the blind as a whole. This poses a problem when the user wants to change the interior atmosphere depending on the type of the guests or the change of season.

DISCLOSURE OF THE INVENTION

It is an object of the present invention to provide a blind which positively utilizes transmission or reflection (diffused reflection and total reflection) of the light for creating a fresh interior atmosphere which conventional blinds are unable to produce without hindering its functions to adjust and block the light.

The above object includes an object to make substantially inconspicuous the graphic pattern forming regions on the base boards of the slats when a significant graphic pattern is disappeared while the blind is closed.

The above object also includes an object to enable a significant graphic pattern produced by the graphic pattern forming regions on the base boards of the slats to be changed without replacing the blind.

The above object also includes an object to prevent a significant graphic pattern produced for direct viewing from being disturbed by excessive reflection of the light from the surfaces of the base boards of the slats.

Other objects of the present invention are apparent from the following description and "BEST MODE FOR CARRYING OUT THE INVENTION" given below.

To achieve the above objects, an aspect of the present application is arranged as follows:

A blind has parallel slats which are angularly movable simultaneously about their own longitudinal axes;

each slat has a graphic pattern forming region on a base board of transparent material;

the base board has, in its cross section transverse to the longitudinal axis thereof, a central surface, a first bent surface bent obliquely upward from one edge of the central surface, and a second bent surface bent obliquely downward from the other edge;

the graphic pattern forming regions of the respective slats are arranged so that when the slats are angularly moved and tilted at a predetermined angle, they are combined with each other to produce a significant graphic pattern for an observer on the entire blind; and each of the graphic pattern forming regions comprises a diffused-reflection surface composed of fine irregularities on a portion of a surface of the base board.

In the blind of the above-described arrangement, when the slats are turned at a predetermined angle, the graphic pattern forming regions thereof are combined with each other to form a light-shielding portion (projection type) or a reflecting portion (direct-type) for diffused reflection, thereby producing on the entire blind a graphic pattern which is significant for the observer. The significant graphic pattern creates an excellent interior atmosphere. The light-shielding portion blocks the light coming from behind the blind and forms a shadow on a wall or floor (projection). The reflecting portion for diffused reflection reflects the light coming from the side of the observer, thereby enabling the observer to recognize the graphic pattern.

The predetermined angle for the slats is an angle at which the significant graphic pattern appears most clearly on the blind surface due to reflection, or an angle at which the significant graphic pattern appears most clearly on a wall or floor by projection. This angle is set to a suitable value depending on the direction of the observer's eyes or the direction of the light coming from the side of the interior (the side of the observer) or the side of the outdoors.

Since the graphic pattern forming regions comprise the diffused-reflection surfaces composed of fine irregularities provided on a portion of a surface of the base board, a clear image is projected onto the wall or floor by the light transmitted from behind the blind. As the light reflected by these surfaces is of soft white color, so that the graphic pattern forming regions are not so conspicuous while the significant graphic pattern has disappeared with the blind closed. Consequently, the interior atmosphere is not spoiled even when the significant graphic pattern has disappeared from the blind.

To achieve the above objects, another aspect of the present application is arranged as follows:

A blind has parallel slats which are angularly movable simultaneously about their own longitudinal axes;

each slat has a graphic pattern forming region on a base board of transparent material;

the base board has, in its cross section transverse to the longitudinal axis thereof, a central surface, a first bent surface bent obliquely upward from one edge of the central surface, and a second bent surface bent obliquely downward from the other edge;

the graphic pattern forming regions of the respective slats are arranged so that when the slats are angularly moved and tilted at a predetermined angle, they are combined with each other to produce a graphic pattern on the entire blind which is significant for the observer; and each of the graphic pattern forming regions comprises a highlighted surface for blocking and strongly reflecting the light, on a portion of a surface of the transparent base board.

In the blind of the above-described arrangement, when the slats are turned at a predetermined angle, the graphic pattern forming regions thereof are combined with each other to produce a significant graphic pattern. When the blind is viewed in the direct viewing type, the significant graphic pattern is formed by a dark portion behind the blind against a background of a bright portion provided by the highlighted surface. When the blind is viewed in the projection type, the significant graphic pattern is formed on a wall or floor by the transmitted light. In this case, the graphic pattern is an image in which the bright and dark areas of the graphic pattern are reversed to those of the image on the direct viewing type, thereby creating an excellent interior mood.

The significant graphic pattern (direct-type) produced by highlighted graphic pattern forming area looks as a raised bright graphic pattern against a dark background, since the back surface of the blind is darker than the surface on the side of the observer, thereby developing a unique but a significant graphic pattern to create an interior atmosphere different from the significant graphic pattern produced by the diffused reflection (also in the direct viewing type).

To achieve the above objects, still another aspect of the present application is arranged as follows:

A blind has parallel slats which are angularly movable simultaneously about their own longitudinal axes:

each slat has a graphic pattern forming region on a base board of transparent material;

the base board has, in its cross section transverse to the longitudinal axis thereof, a central surface, a first bent surface bent obliquely upward from one edge of the central surface, and a second bent surface bent obliquely downward from the other edge;

the graphic pattern forming regions of the respective slats are arranged so that when the slats are angularly moved and tilted at a predetermined angle, the graphic pattern forming regions of the respective slats are combined with each other to produce a significant graphic pattern for an observer on the entire blind; and the second bent surface has a distal edge closer to a center than the junction between the central surface and the second bent surface.

In the blind of the above-described arrangement, when the slats are turned at a predetermined angle, the graphic pattern forming regions thereof are combined with each other to form a light-shielding portion (projection type) or a reflecting portion (direct-type), and the blind as a whole provides a graphic pattern which is significant for the observer. The significant graphic pattern creates an excellent interior atmosphere. The significant graphic pattern is formed by a projection in which the light from behind the blind is blocked by the graphic pattern forming regions or a reflection (diffused reflection, total reflection) from the graphic pattern forming regions on the blind.

The distal edge of the second bent surface is set closer to the center than the junction between the central surface and the second bent surface. Therefore, when the slats are turned about their longitudinal axes in a direction to elevate the first bent surfaces and lower the second bent surfaces to close the blind, the light from the side of the observer to the blind is reflected by the base board surface other than the graphic pattern forming regions of the slats, which are not viewed by the observer, irrespective of which side of the blind faces the observer. Thus, when the significant graphic pattern is produced in the direct-type, the graphic patterns can be prevented from being disturbed by the excessive light reflected from the base board surface.

To achieve the above objects, a further aspect of the present application is arranged as follows:

A blind has parallel slats which are angularly movable simultaneously about their own longitudinal axes;

each slat has a graphic pattern forming region on a base board of transparent material;

the base board has, in its cross section transverse to the longitudinal axis thereof, a central surface, a first bent surface projecting substantially perpendicularly upward from an edge on one side of the central surface, and a second bent surface projecting substantially perpendicularly downwardly from the other edge on an opposite side of the central surface;

the graphic pattern forming regions of the slats are arranged so that when the slats are angularly moved and tilted at a predetermined angle, the graphic pattern forming regions of the surfaces produce a graphic pattern which is significant for the observer.

In the blind of this arrangement too, when the slats are turned at a predetermined angle, the graphic pattern forming regions thereof are combined with each other to form a light-shielding portion (projection type) or a reflecting portion (direct-type), thereby producing a graphic pattern which is significant for the observer. This significant graphic pattern creates an excellent interior atmosphere. The significant graphic pattern is formed by a projection in which the light from behind the blind is blocked by the graphic pattern forming regions or by a reflection from the graphic pattern forming regions on the blind.

Since the first and second bent surfaces project substantially perpendicularly upward from the central surface, the width of the slat (a dimension in a direction normal to the longitudinal axes thereof) can be reduced, and the resistance against bending is increased for each slat.

To achieve the above objects, another aspect according to the present application is accomplished by adding the following arrangements to the above aspects:

Each of the first and second bent surfaces comprises a transparent pouched double-wall portion with an open side end, and a graphic pattern piece having a cut-out shape corresponding to a graphic pattern forming region which is to be borne by each of the first and second bent surfaces, is removably inserted into the pouched double-wall portion.

When the graphic pattern pieces are moved in the pouched double-wall portions or replaced, the combinations with the graphic pattern forming regions of the other slats are varied, thus varying a projection produced by the entire blind to be viewed by the observer or the significant graphic pattern produced in the direct type.

The significant graphic pattern produced by the graphic pattern forming regions of the slats can thus be varied without replacing the blind, so that an appropriate interior atmosphere can be created depending on the type of the guests or the season.

To achieve the above objects, still another aspect according to the present application is accomplished by adding the foillowing arrangements to the above inventions:

Each of the first and second bent surfaces comprises a transparent pouched double-wall portion with an open side end, and an insert of a transparent base board having a graphic pattern forming region which is to be borne by each of the first and second bent surfaces, is removably inserted in the pouched double-wall portion.

When the inserts are moved in the pouched double-wall portions or replaced, the combinations with the graphic pattern forming regions of the other slats are varied, thus varying a projection produced by the entire blind to be viewed by the observer or the significant graphic pattern produced by the direct-type blind. In this case, since the insert comprises a base board having a graphic pattern forming region, which is to be borne by the first and second bent surfaces, the insert can smoothly and easily be moved in the pouched double-wall portion.

The significant graphic pattern produced by the graphic pattern forming regions of the slats can thus be varied without replacing the blind, so that an appropriate interior atmosphere can be created depending on the type of the guests or the season.

To achieve the above objects, yet still another aspect according to the present application is accomplished by adding the following arrangements to the above aspects:

The base board comprises a flattened tubular member. The tubular member includes those ranging from a tube having a completely closed cross section to one having an unclosed ring-shaped cross section with a cut-out.

This structure enables the pouched double-wall portion to be easily produced.

In each of the above aspects, when the blind is closed, the slats are turned into overlapping condition in which they block the light, and when the blind is open, the slats lie horizontally, giving a maximum opening as viewed from the front side of the blind.

BRIEF DESCRIPTION OF THE DRAWINGS

FIG. 8 is a fragmentary side elevational view showing the principal part of the blind according to the first embodiment when the blind is closed;

FIG. 18 is a fragmentary front elevational view of the principal part of the blind according to the second embodiment when the blind is fully closed;

BEST MODE FOR CARRYING OUT THE INVENTION

Figure 1:
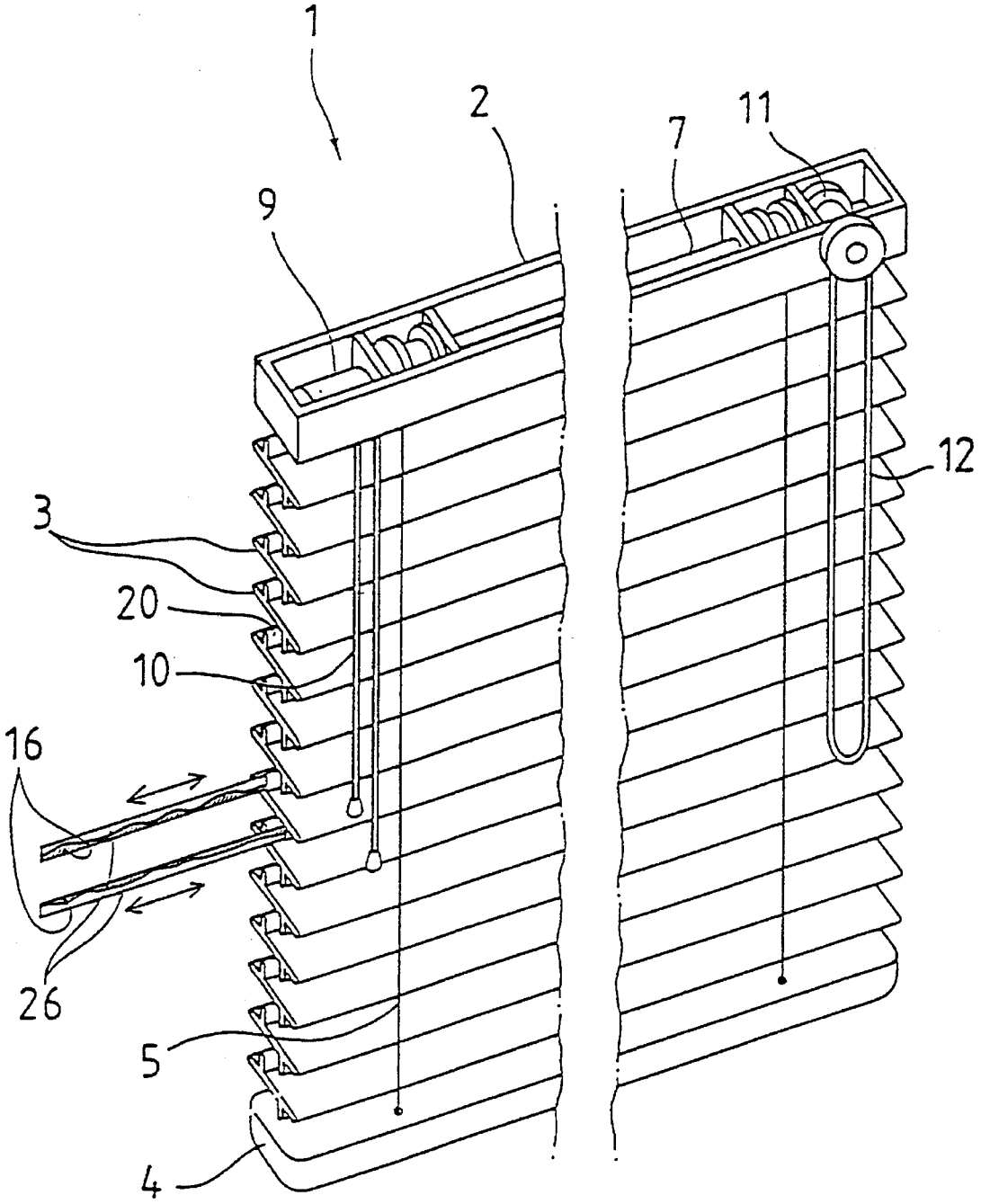
FIG. 1 is a perspective view of a blind according to a first embodiment of the present invention.

Embodiments of the present invention will hereinafter be described in detail with reference to the drawings.

FIGS. 1 through 10 show a first embodiment of the present invention.

A blind i has a number of slats 3 and a lower plate 4, which serves as a weight, attached to a lower surface of a storage box 2 by laterally spaced ladder cords 5 and a lift cord 6.

The ladder cords 5, which takes a ladder form as a whole (FIG. 2), include lateral cords 8 attached at constant intervals between front and rear vertical cords 7 and 7', the front vertical cord 7 facing the observer. The ladder cords 5 have upper ends mounted on a turning device 9 housed in the storage box 2, and lower ends fixed to the lower plate 4. The slats have opposite ends placed on the respective lateral cords 8. The turning device 9 can be turned by a slat turning control cord 10.

The lift cords 8 extend through the opposite ends of the slats 3 without being restricted thereby. The lift cords 6 have upper ends attached to a winding device 11 housed in the storage box 2, and lower ends secured to the lower plate 4. The winding device 11 can be turned by a blind lifting/lowering cord 12.

When the blind lifting/lowering cord 12 is operated in a direction to lift the blind 1, the lift cords 6 are wound by the winding device 11, and the blind 1 is lifted so that lower slats 3 move closer to and underlie upper slats 3, whereby the blind 1 is fully wound up. When the blind lifting/lowering cord 12 is operated in a direction to lower the blind 1, the blind 1 is unwound to allow the lower plate 4 to move downward by gravity, while the lower slats 3 are moved away from upper slats 3 to be released gradually from the mutually stacked relationship, thereby allowing to blind 1 extend downward.

When the slat turning control cord 10 is operated, the vertical cords 7 and 7', of the front and rear sides with respect to the observer, move in opposite upper and lower directions respectively, thereby varying the inclination of the lateral cords 8 to cause each of the slats 3 to turn simultaneously about its longitudinal axis from a fully open condition to a fully closed condition. According to the present invention, furthermore, there exists a condition in which each of the slat 3 is tilted at a predetermined angle with respect to a direction P1 along which the observer views the blind 1 and a direction P2 along which light is introduced from behind the blind 1, between the fully open condition and the fully closed condition.

Each of the turning devices 9 and the winding device 11 has a friction stop or click stop mechanism for keeping the slats 3 or the blind 1 at a desired turned or wound position.

Figure 3:
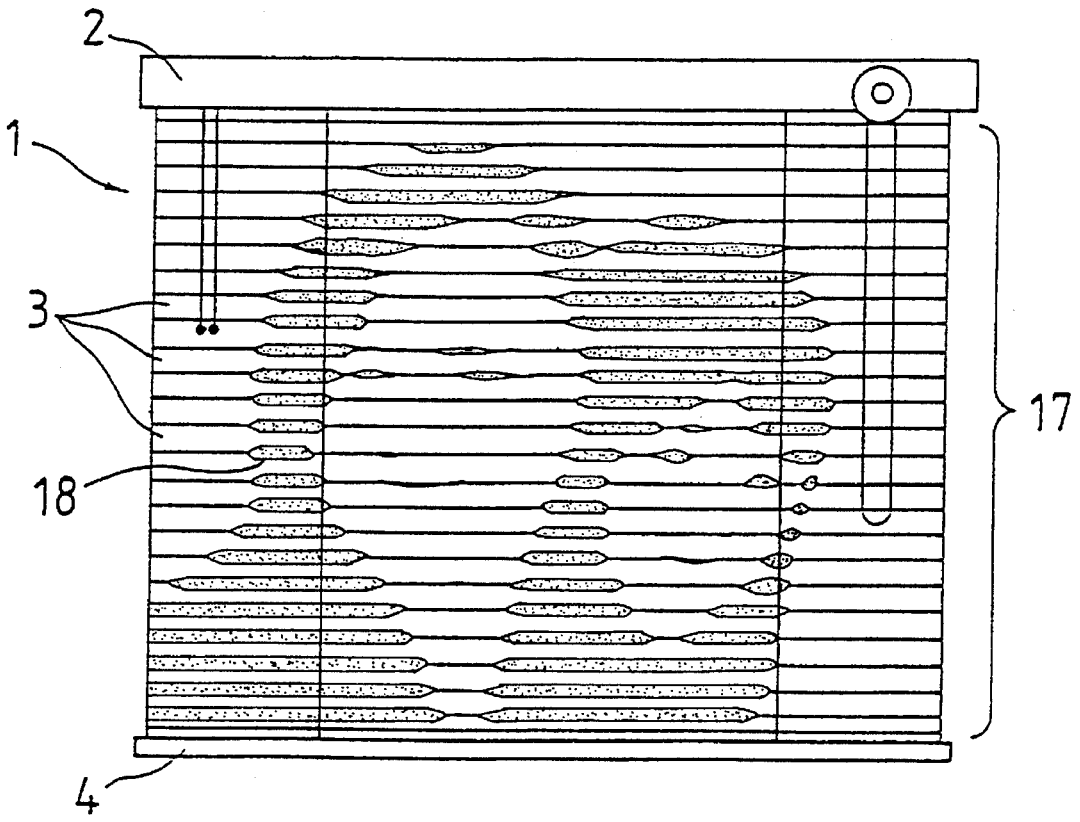
FIG. 3 is a front elevational view of the blind according to the first embodiment with a significant graphic pattern appearing.

The fully open condition is a condition in which the slats 3 lie substantially parallel to each other with a maximum distance therebetween. The fully closed condition is a condition in which the slats 3 lie substantially vertically and overlap each other. The condition in which the slats 3 are tilted at a predetermined angle is a condition in which the blind 1 as a whole produces a significant graphic pattern, for example a graphic pattern 18 representing the image of two smiling women, as shown in FIG. 3. Such significant graphic pattern 18 is a graphic pattern which is produced on a blind surface 17 by combining the graphic pattern forming regions 18 of slats 3, and which gives the observer in the interior space some impression through the visual sensation.

Figure 4:
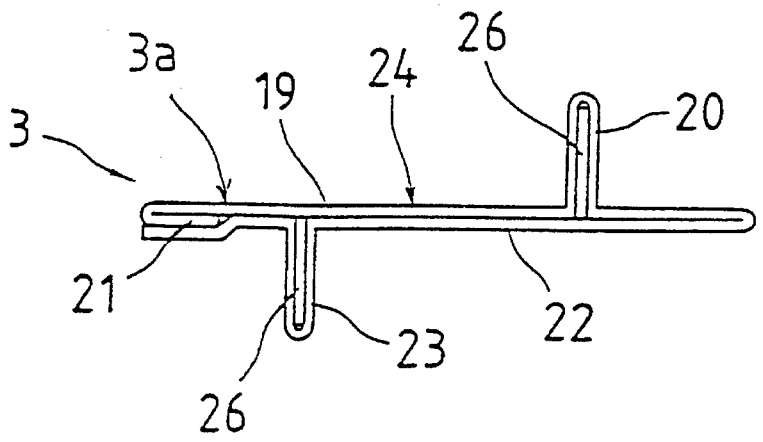
FIG. 4 is a side elevational view of a slat of the blind according to the first embodiment.

As shown in FIG. 4, each of the slats 3 comprises a base board **3*a* which is made from a belt-shaped acetate sheet (or a transparent sheet of other synthetic resin). The acetate sheet is folded back to form upper and lower layers along its longitudinal axis, thereby providing a base board 3*a*. The base board 3*a* is bent upward substantially at a right angle near a folded end of an upper surface portion 19 and then bent back downwardly, thereby providing a first bent surface portion 20. The first bent surface portion 20 comprises a hollow narrow pouched double-wall portion with an open side end. The other end of the upper surface portion 19 is bent back toward a lower surface of the base board 3*a*, providing a bent-back portion 21. The lower surface portion 22 of the base board 3*a* is formed by folding back the upper surface portion 19, and is bent downward substantially at a right angle near the other end and then bent back upwardly, thereby providing a second bent surface portion 23. The lower surface portion 22 has a distal end underlying the lower surface of the bent-back portion 21 of the upper surface portion 19. The second bent surface portion 23 also comprises a hollow narrow pouched double-wall portion with an open side end. The upper surface portion 19, the lower surface portion 22, and the bent-back portion 21 except the first and second bent surface portions 20 and 22 are bonded together by an adhesive or the like. The first and second bent surface portions 20 and 23 are joined to each other by a central surface 24**.

Inserts 26 which comprise a belt-shaped acetate sheet (or a transparent sheet of other synthetic resin) are removably inserted from insertion slots 25 into the first and second bent surface portions 20 and 23, each comprising a hollow narrow pouched double-wall portion.

Each of the slats 3 has a graphic pattern forming region 16 on its transparent base board **3*a*, the graphic pattern forming region 16 producing a graphic pattern by blocking or reflecting light. "Blocking light" is a function to block the ray of light from behind the blind 1 for forming (projecting) a shadow on a wall or a floor. "Reflecting light" is a function to reflect the ray of light from the side of the observer as diffused or total reflection to make the observer recognize the graphic pattern forming region 16**.

In this embodiment, the inserts 28 removably inserted in the first and second bent surface portions 20 and 23 of the base board **3*a*, and the central surface 24 are coated with an opaque paint thereby to provide the graphic pattern forming region 16. The central surface 24 is coated on its entire area, and the inserts 26 are coated from portions joining to the central surface 24 toward distal edges thereof, to form coating irregularities. These coating irregularities are meaningless on a single insert 26. However, when the slats 3 are tilted at a predetermined angle, the graphic pattern forming regions 16 on the slats 3 are combined with each other to produce the significant graphic pattern 18** on the overall blind. In actual case, an attractive portrait photograph (black and white) of a person, for example, is divided into a number of horizontal strips, and the black or white portion on each strip is transferred as a graphic pattern forming region onto a transparent board.

Figure 8:
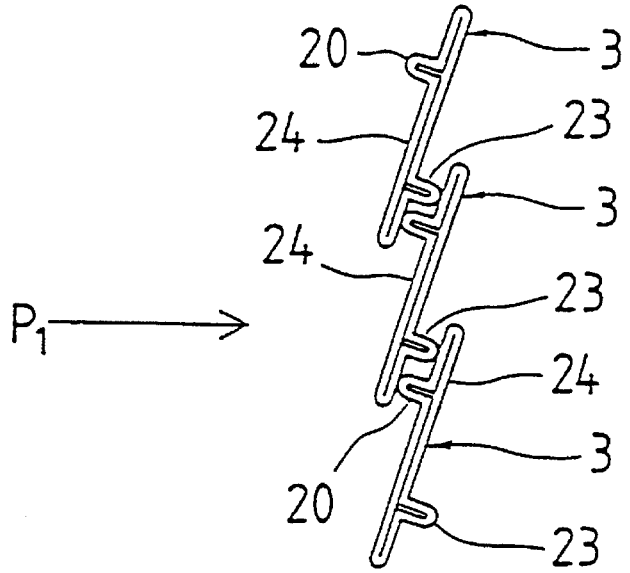
FIG. 8 is a fragmentary side elevational view of principal part showing the slats tilted at a predetermined angle in the blind according to the first embodiment.

As shown in FIG. 8, when the slats 3 are tilted so that the central surfaces 24 lie parallel to the direction P1 of the observer's eyes, the first and second bent surfaces 20 and 23 are erected substantially perpendicularly to the direction P1, permitting the graphic pattern forming regions 16 on the inserts 26 to be viewed from the front side of the blind.

Figure 7:
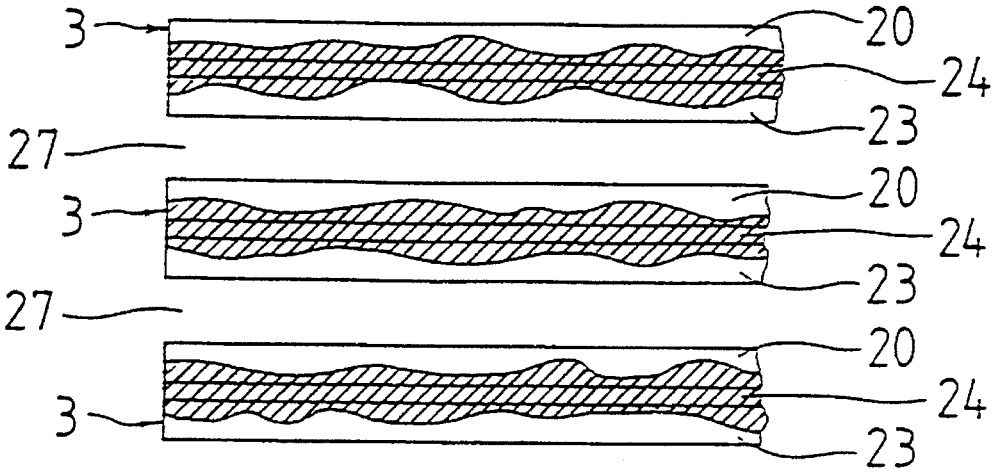
FIG. 7 is a fragmentary front elevational view of principal part showing the slats tilted at the predetermined angle in the blind according to the first embodiment.

Thus, the graphic pattern forming regions 16 on the slats 3 are seen as viewed in FIG. 7. On the blind surface 17 as a whole, the entire graphic pattern forming regions 18 are combined to produce the significant graphic pattern 18 as shown in FIG. 3.

The significant graphic pattern 18 appears when a shadow produced by blocking the light P1 from behind the blind with the graphic pattern forming regions 16 is recognized by the observer (direct-type). The shadow may be projected onto a wall or floor, and recognized by the observer (projection type). In addition, when no light comes from behind the blind during night or the like, the light from the side of the observer, i.e., the light from an interior lamp, may be reflected by the graphic pattern forming regions 16 (diffused reflection), and recognized by the observer (direct-type).

When the inserts 26 in the respective slats 3 are replaced, the position or size of the graphic pattern forming regions 16 on the first and second bent surfaces 20 and 23 is varied, thereby enabling the appearing significant graphic pattern 18 to be varied. Thus, the significant graphic pattern 18 can be varied without replacing the whole of the blind 1.

Depending on the graphic pattern, the same inserts 26 may be use for changing the graphic pattern by simply changing their positions in the first and second bent surfaces 20 and 23. This holds true for both the direct-type and the projection type.

Figure 6:
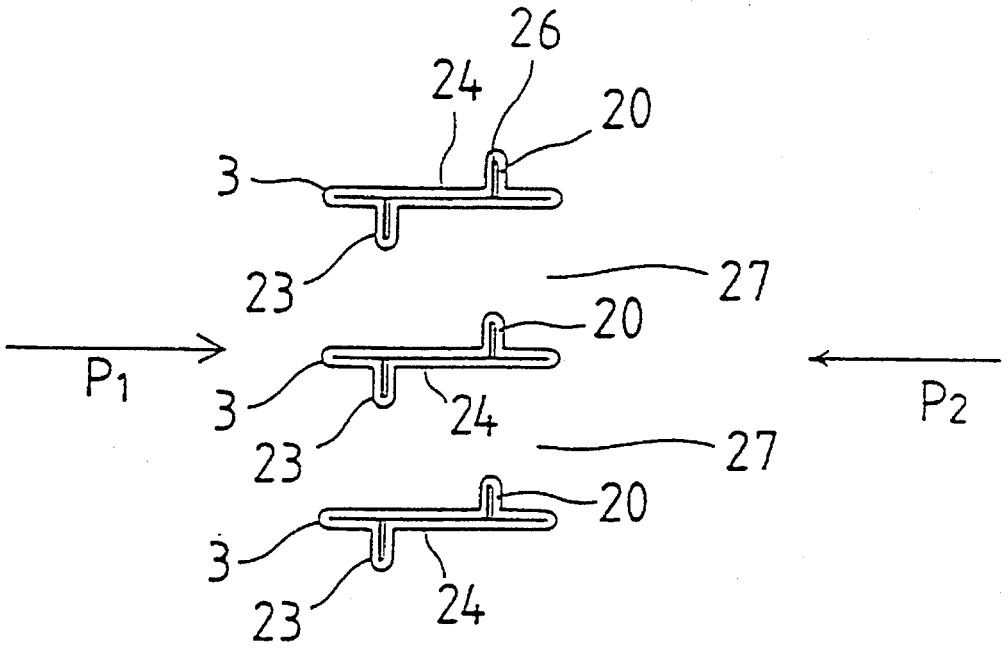

In FIG. 6, the direction P1 is set to a horizontal direction, so that the angle at which the slats 3 are tilted is a predetermined angle for allowing the significant graphic pattern 18 to appear, as well as an angle for an open condition in which the greatest gaps 27 are provided between the slats 3.

Figure 9:
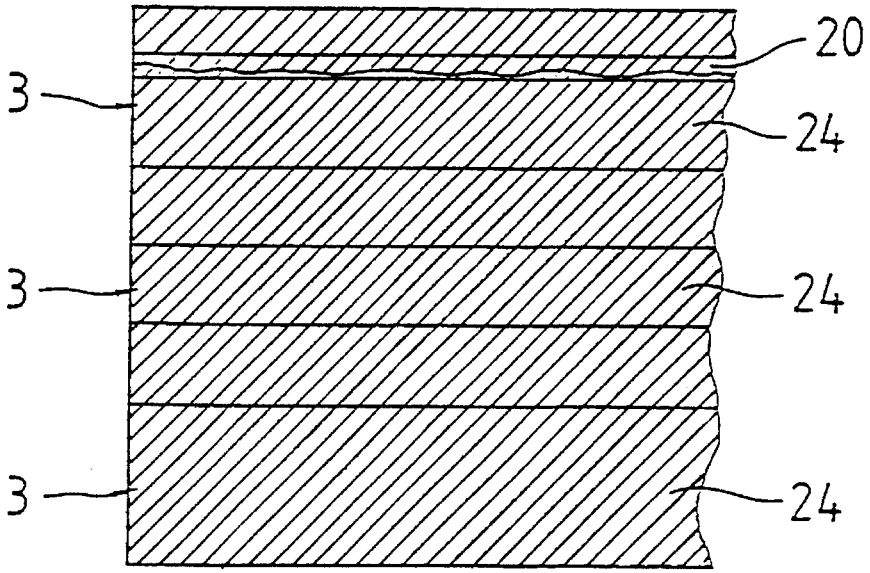
FIG. 9 is a fragmentary front elevational view of the principal part of the blind according to the first embodiment when the blind is closed.

When the slats 3 are turned across the direction P1 of the observer's eyes until the upper and lower edges thereof overlap each other, the blind 8 is closed as shown in FIG. 8. In this condition, as shown in FIG. 9, the graphic pattern forming regions 16 on the inserts 24 in the first and second bent surfaces 20 and 23, and the central surface 24 are joined, and the significant graphic pattern 18 disappears, with the blind surface 17 blocking the light as a whole.

As described above, by adjusting the angle of the slats 3 of the blind 1, the significant graphic pattern 18 appears on the blind surface 17 thereby creating an excellent atmosphere in an interior space. The atmosphere thus created is highly effective in both the space at home and the space for business.

In the first embodiment, acetate sheets are bonded into two layers as the base board **3*a*, and the first and second bent surfaces 20 and 23 are formed to serve as stiffening ribs of the slats 3**, thereby increasing their mechanical strengths to reduce the fear of bending or breakage.

The significant graphic pattern 18 which appears on the blind surface 17 may be replaced with one suitable for a desired interior atmosphere simply by replacing the inserts 28 inserted into in the first and second bent surfaces 20 and 23 with those having other graphic pattern forming regions 18, or by adjusting the position of the inserts 28 in the first and second bent surfaces 20 and 23.

Figure 10:
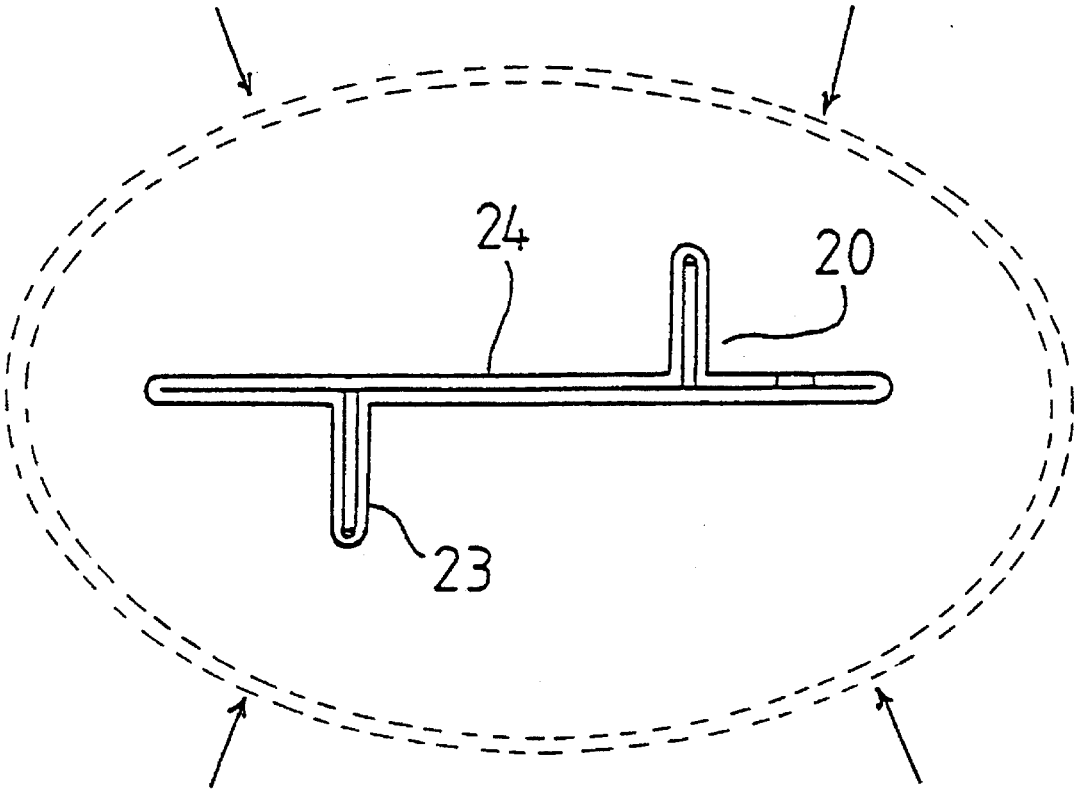
FIG. 10 is a side elevational view showing a condition of a material of which the slats of blind according to the first embodiment are made.

The base board **3*a* may be other transparent synthetic resin sheet such as a vinyl chloride sheet than the acetate sheet. As shown in FIG. 10, the base board 3*a* can also be formed at a time by inwardly pressing with heat a material 3*b* (having a ring-shaped cross section with a cutout). To form pouched double-wall portions of the first and second bent surfaces 20 and 23**, a core is inserted therinto in advance.

Besides coating with a paint or printing, the graphic pattern forming regions 18 may be produced by attaching paper or metal foil, or by applying sand to provide a diffused reflection surface with fine irregularities on the surface of the base board.

Substantially the same effect can be obtained by forming only one of the first and second bent surfaces 20 and 23 into a pouched double-wall portion. For the other bent surface which does not comprise a pouched double-wall portion, a graphic pattern forming region 16 is formed directly on the surface of the base board **3*a***.

Figure 11:
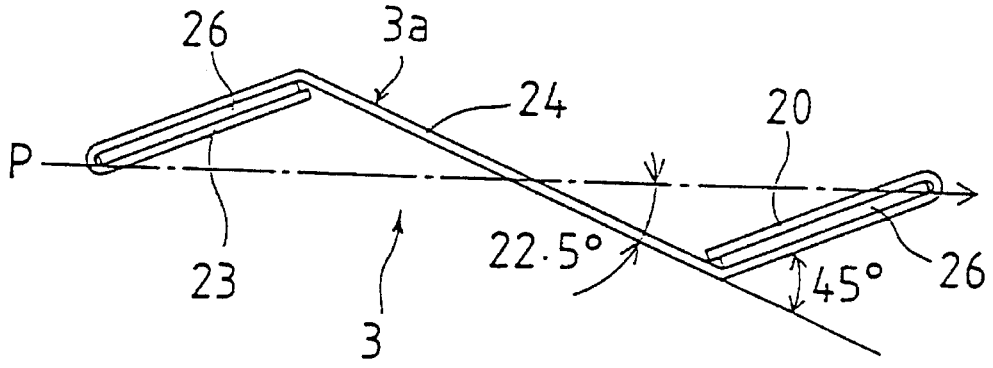
FIG. 11 is a cross-sectional view of a slat of a blind according to a second embodiment of the present invention.

FIG. 11 shows a slat 3 of a blind according to a second embodiment of the present invention. A base board **3*a* is formed with a hard vinyl chloride sheet. The base board 3*a* has a central surface 24, a first bent surface 20 bent obliquely upward at an angle of about 45° from a rear end of the central surface 24 and having a width which is about a half of the width of the central surface 24, and a second bent surface 23 bent obliquely downward at an angle of about 45° from a front end of the central surface 24 and having a width which is about a half of the width of the central surface 24. That is, the base board 3*a* has an elongated Z- or S-shaped cross section perpendicular to the longitudinal axis of the slat 3**.

Figure 12:
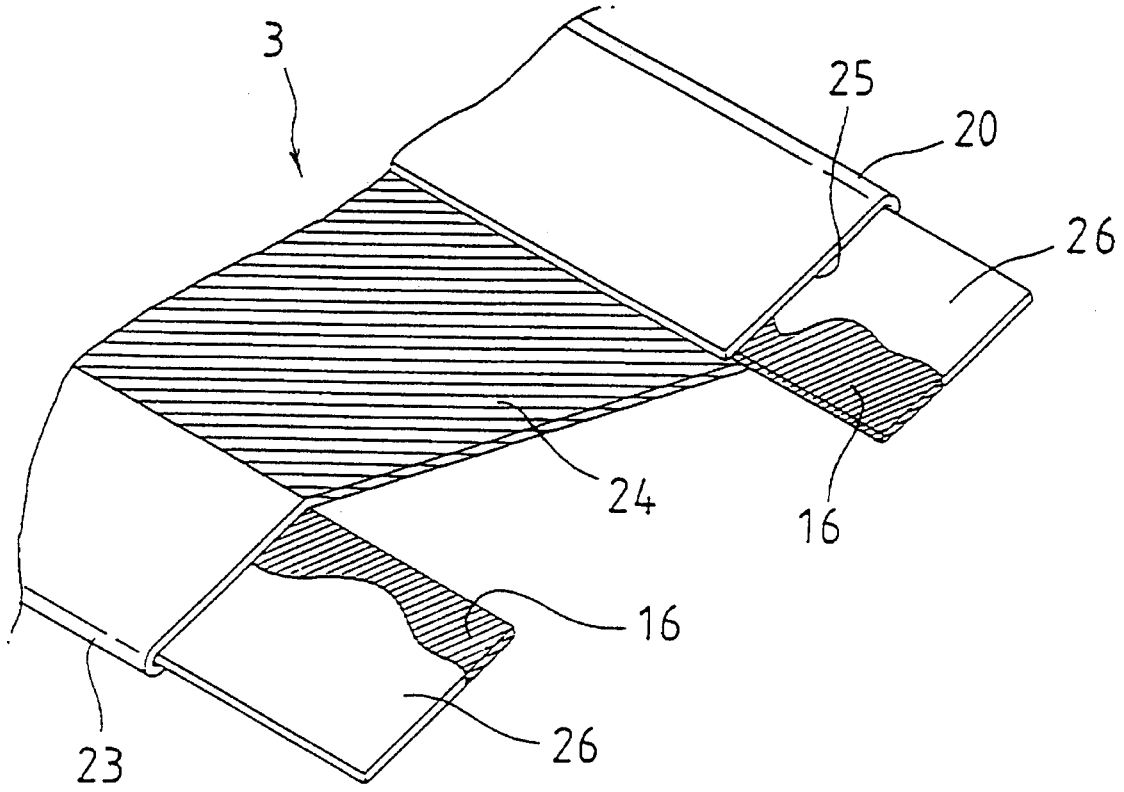
FIG. 12 is fragmentary perspective view of the principal part of the slat of the blind according to a second embodiment of the present invention.

The first and second bent surfaces 20 and 23 comprise pouched double-wall portions formed by folding back the sheet. Inserts 28 each made of a transparent vinyl chloride sheet are removably inserted into the pouched double-wall portions (FIG. 12). Light-shielding colored paper sheets are attached to the central surface 24 of the transparent base board **3*a* and the inserts 26, thereby forming graphic pattern forming regions 16**.

The other details of the blind 1 according to the second embodiment are substantially the same as those of the first embodiment, and will not be described below.

Figure 13:
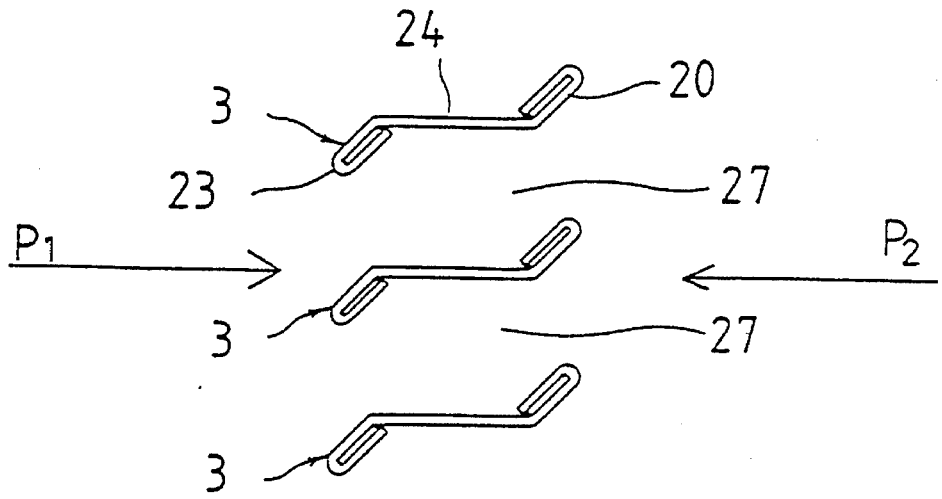
FIG. 13 is a fragmentary side elevational view of the principal part of the slats tilted at a predetermined angle in the blind according to the second embodiment.
Figure 14:
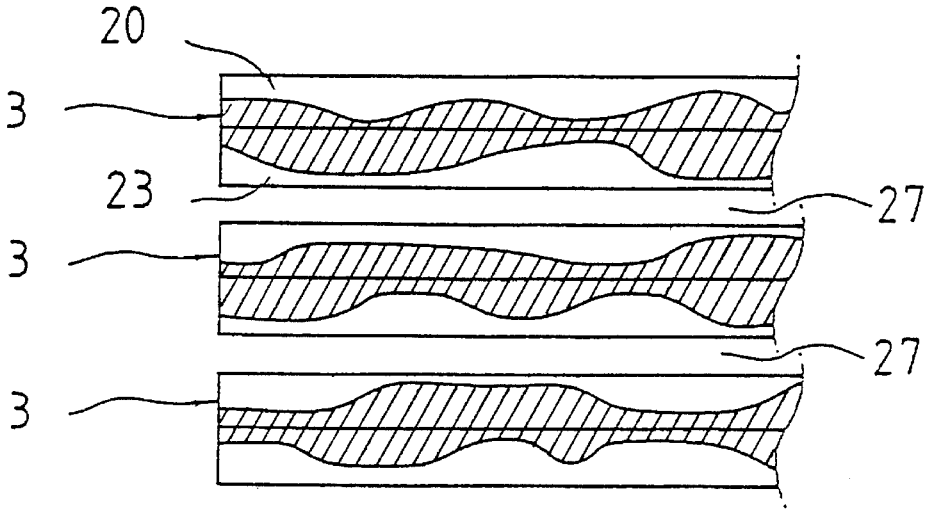
FIG. 14 is a fragmentary front elevational view of the principal part of the slats tilted at the predetermined anngle according to the second embodiment.

In FIG. 13, the slats 3 are partly open at a predetermined angle with respect to the direction P1 of the observer's eyes or the direction P2 along which light is introduced from behind the blind 1. In this condition, the graphic pattern forming regions 16 on the first and second bent surfaces 20 and 23 rise at a suitable angle with respect to the direction P1 or P2, and hence can be observed or projected with a certain area and a clear outline as shown in FIG. 14. As a result, the graphic pattern forming regions 18 are combined with each other, producing a significant graphic pattern 18 on the blind surface 17. As in the case of the first embodiment, the significant graphic pattern 18 is recognized by the observer by being directly viewed or projected onto the wall or floor, thereby producing an excellent interior atmosphere.

Figure 15:
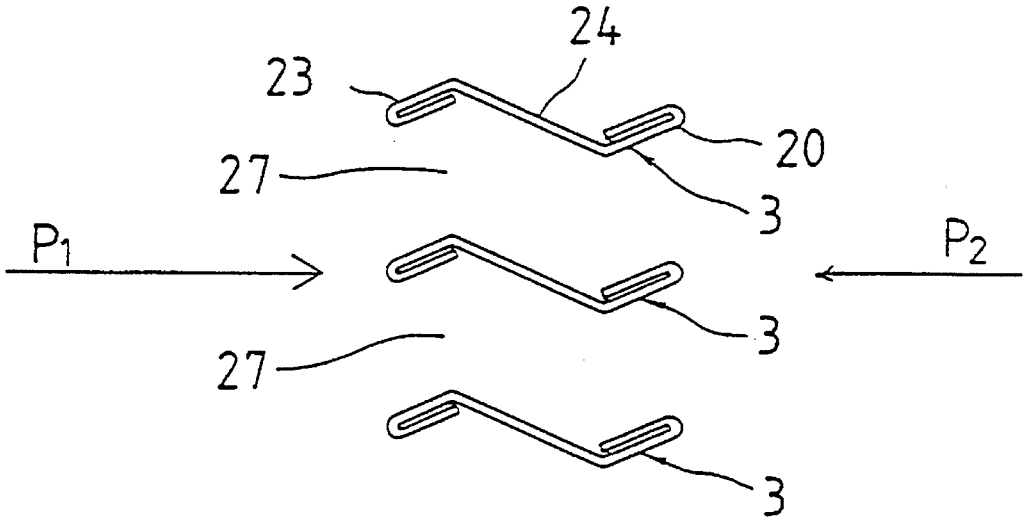
FIG. 15 is a fragmentary side elevational view of the principal part ofthe blind according to the second embodiment when the blind is fully open.

FIG. 15 shows the blind 1 as it is fully open with the slats 3 tilted so that the central surfaces 24 are inclined at an angle of about 22.5° to the direction P1 or P2. In this case, the graphic pattern forming regions 16 on the inserts 26 in the first and second bent surfaces 20 and 23 overlap each other with respect to the direction P1 (FIG. 16), thereby preventing the significant graphic pattern 18 from appearing on the blind surface 17. The gaps 27 between the slats 3 become maximum.

Figure 17:
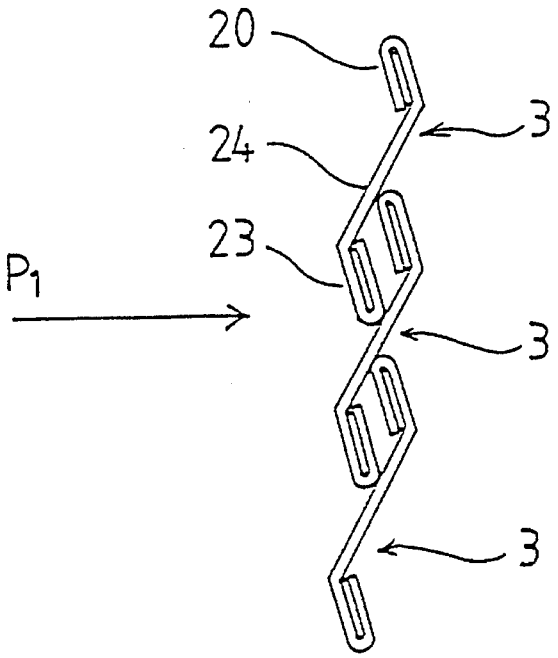
FIG. 17 is a fragmentary side elevational view of the principal part of the blind according to the second embodiment when the blind is fully closed.
Figure 18:
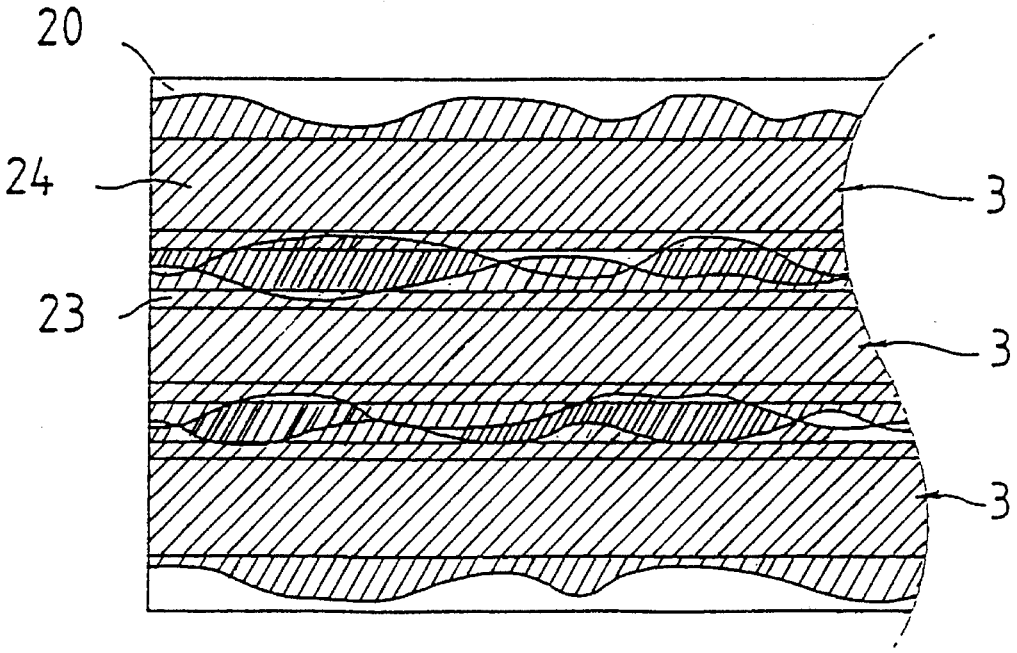
FIG. 18 is a fragmentary front elevational view of the principal part of the blind according to the second embodiment when the blind is-fully open.

FIG. 17 shows the blind 1 according to the second embodiment which is fully closed. When the slats 3 are erected across the direction P1, and the graphic pattern forming regions 16 on the slats 3 overlap each other. The light from the exterior is blocked substantially completely as shown in FIG. 18.

In the second embodiment, the angles of the first and second bent surfaces 20 and 23 with respect to the central surface 24 of the slat 3 may be set within the range of 20° to 50° and 200° to 230°, respectively. The ratios between the width of the central surface 24 and the widths of the first and second bent surfaces 20 and 23 are not necessarily limited to those illustrated in the embodiment. It is also possible to provide only one of the first and second bent surfaces 20 and 23 with a pouched double-wall portion.

Figure 19:
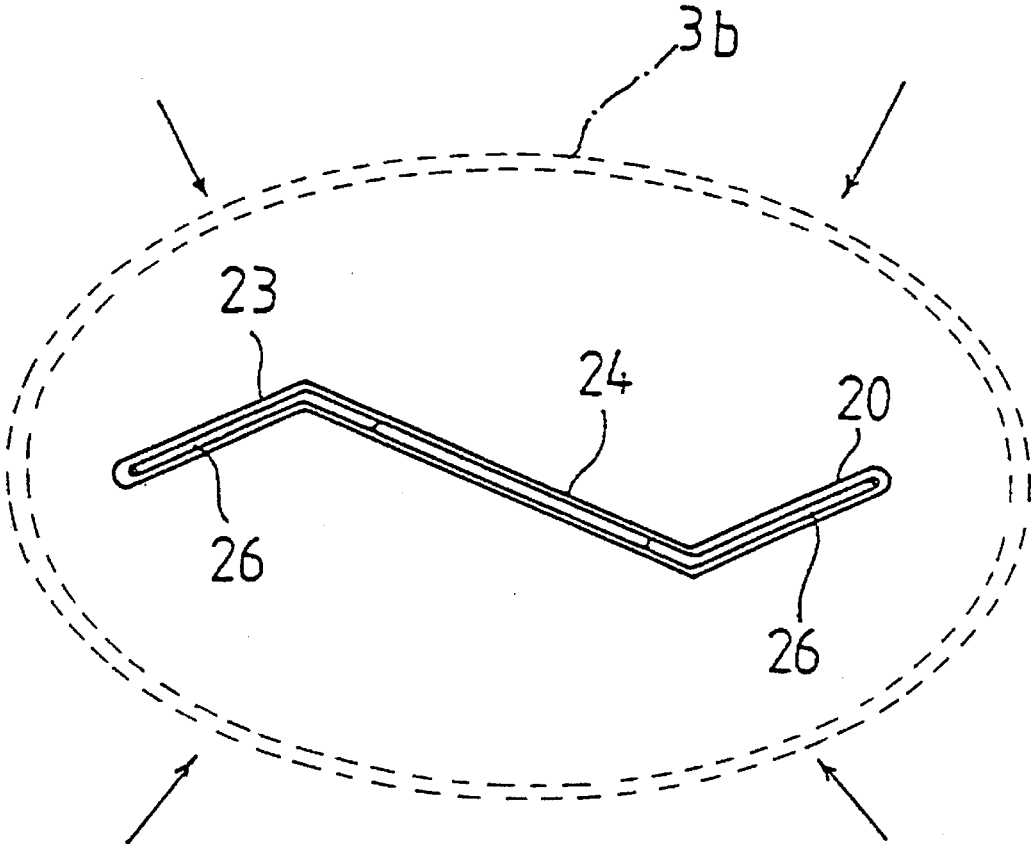
FIG. 19 is a side elevational view showing a condition of a material of the blind according to the second embodiment are made.

As shown in FIG. 19, the base board 3*a* can be formed at a time through not-press process by inwardly pressing a tubular or a tube-like material (having a ring-shaped cross section with a cutout). To form pouched double-wall portions of the first and second bent surfaces 20 and 23, a core is inserted thereinto in advance.

The second embodiment is of a structure simpler than that of the first embodiment, but is capable of providing the similar function an effect as the first embodiment. Furthermore, when the blind 1 is wound up, the gaps between the slats 3 are made smaller than those of the first embodiment.

Figure 20:
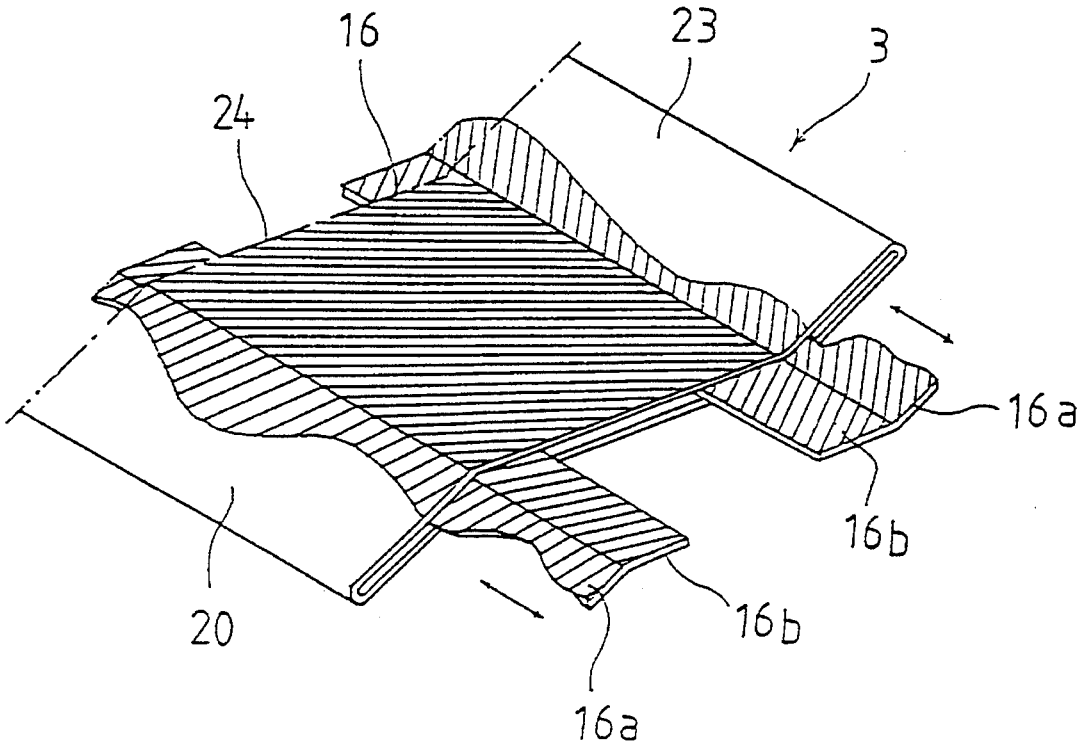
FIG. 20 is a fragmentary perspective view of the principal part of the slat of a blind according to a third embodiment of the present invention.

FIG. 20 shows a third embodiment in which inserts 25 used in the first and second embodiments are formed with rigid metal sheets or cut-out paper sheets 16*a* having the outline of graphic pattern forming regions 16, and are removably inserted into the pouched double-wall portions of the first and second bent surfaces 20 and 23. The cut-out sheets 16*a* have integral reinforcing members 16*b* formed by folding them longitudinally. The base board 3*a* of the third embodiment should preferably be of the structure described with reference to FIG. 19.

With this arrangement, the base board 3*a* will not overlap a transparent portion to reduce the absorption and diffusion of light, so that the significant graphic pattern 18 will have a clear profile. Other specific details are the same as those of the first or second embodiment, and will not be described in further detail.

Figure 21:
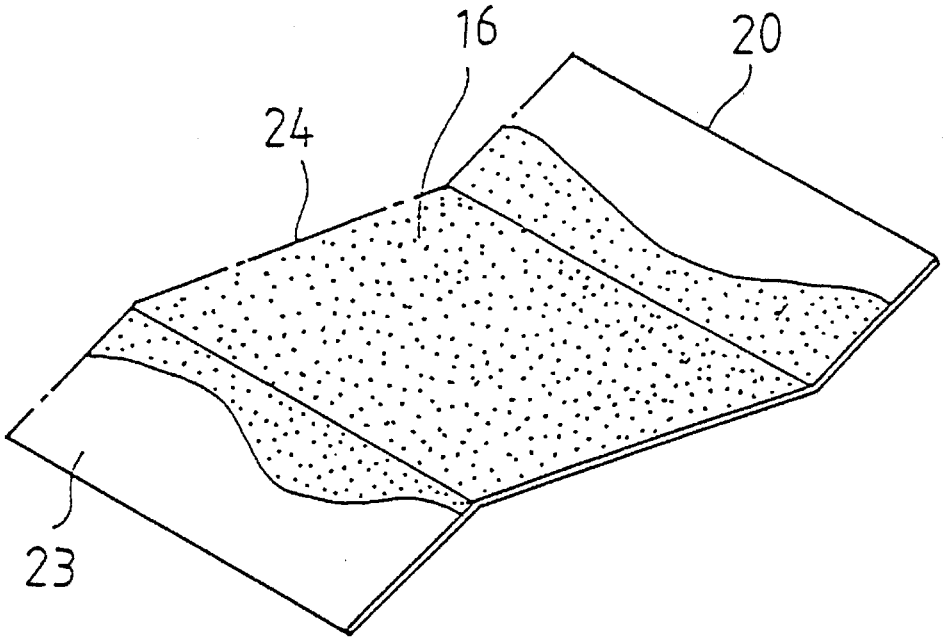
FIG. 21 is a fragmentary perspective view of the principal part of a slat of a blind according to a fourth embodiment of the present invention.

FIG. 21 shows a fourth embodiment, in which the base board 3*a* of a slat 3 is formed by simply bending a single transparent synthetic resin sheet into a central surface 24 and first and second bent surfaces 20 and 23. Sand is blown on the central surface 24 and the first and second bent surfaces 20 and 23 to produce a graphic pattern forming region 16. More specifically, a paper pattern cut corresponding to the shape of the graphic pattern forming region 16 is applied to the surface of the base board 3*a*, and the sand is blown thereon to produce fine irregularities on the surface of the base board 3*a*, which serves as the graphic pattern forming region 16. The graphic pattern forming region 16 thus formed has a soft opalescent color like frosted glass. When exposed to the light applied from behind the blind, it blocks the light because of diffused reflection, producing a clear projected graphic pattern.

Other details are substantially the same as those of the second embodiment, and will not be described in further detail.

The blind according to this embodiment is capable of creating an excellent interior atmosphere with a significant graphic pattern 18 as with the second embodiment. When the blind i is closed causing the significant graphic pattern 18 to disappear from the blind surface 17, the graphic pattern forming region 16 is not so conspicuous as it is opalescent. Thus, the interior atmosphere will not be impaired when the blind 1 is closed.

To make the graphic pattern forming region 16 opalescent, a chemical or electrical embossing technology may be employed besides than the above process.

Functional and effect of this embodiment cannot be obtained by the arrangement disclosed in Japanese patent application No. 62-239948 (Japanese laid-open patent publication No. 64-83795).

Figure 22:
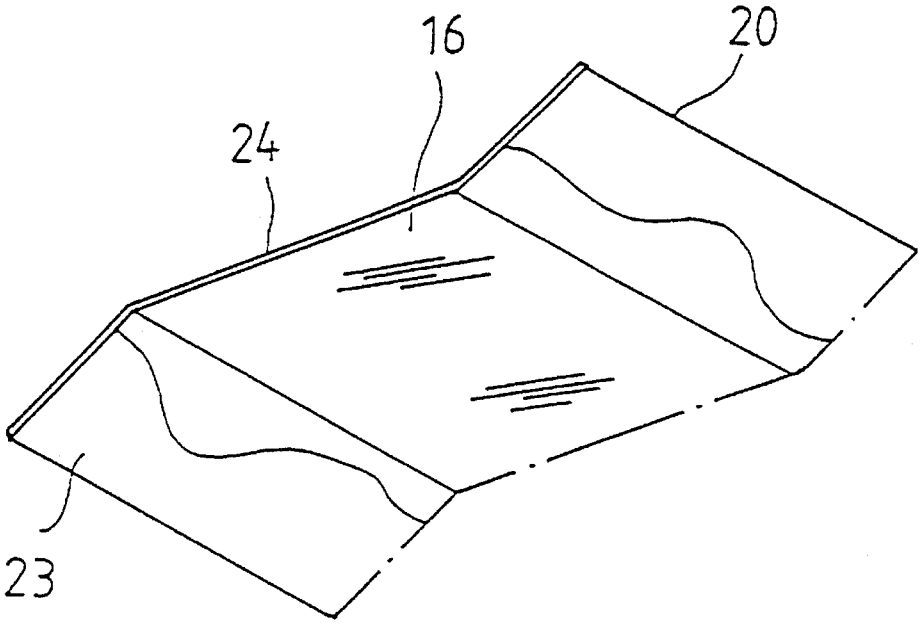
FIG. 22 is a fragmentary perspective back view of the principal part of a slat of a blind according to a fifth embodiment of the present invention.

FIG. 22 shows a fifth embodiment, in which the base board 3*a* of a slat 3 is formed by simply bending a single transparent synthetic resin sheet into a central surface 24 and first and second bent surfaces 20 and 23. A graphic pattern forming region 18 comprises a highlighted surface for strongly reflecting light, the highlighted surface being formed with a paint mixed with fine glass beads and having a high brightness.

Other details are substantially the same as those of the second embodiment, and will not be described in further detail.

In this embodiment, a significant graphic pattern is formed by the gaps between slats and a dark surface other than the graphic pattern forming region 16 of the slat. Specifically, the highlighted area where light from the side of the observer is strongly reflected serves as a background, and the gaps and the dark surface form a graphic pattern against such a background. When the graphic pattern forming region 16 constitutes a light-shielding highlighted surface with respect to the light from behind the blind, a shadow portion serves as a background during daytime, and a light-transmitting portion and the background form a significant graphic pattern with reversed bright and dark regions on a wall or floor.

The above arrangement is effective to create an excellent interior atmosphere. The above function and effects cannot be achieved by the arrangement of disclosed in Japanese patent application No. 82-239948 (Japanese laid-open patent publication No. 64-83795).

Figure 23:
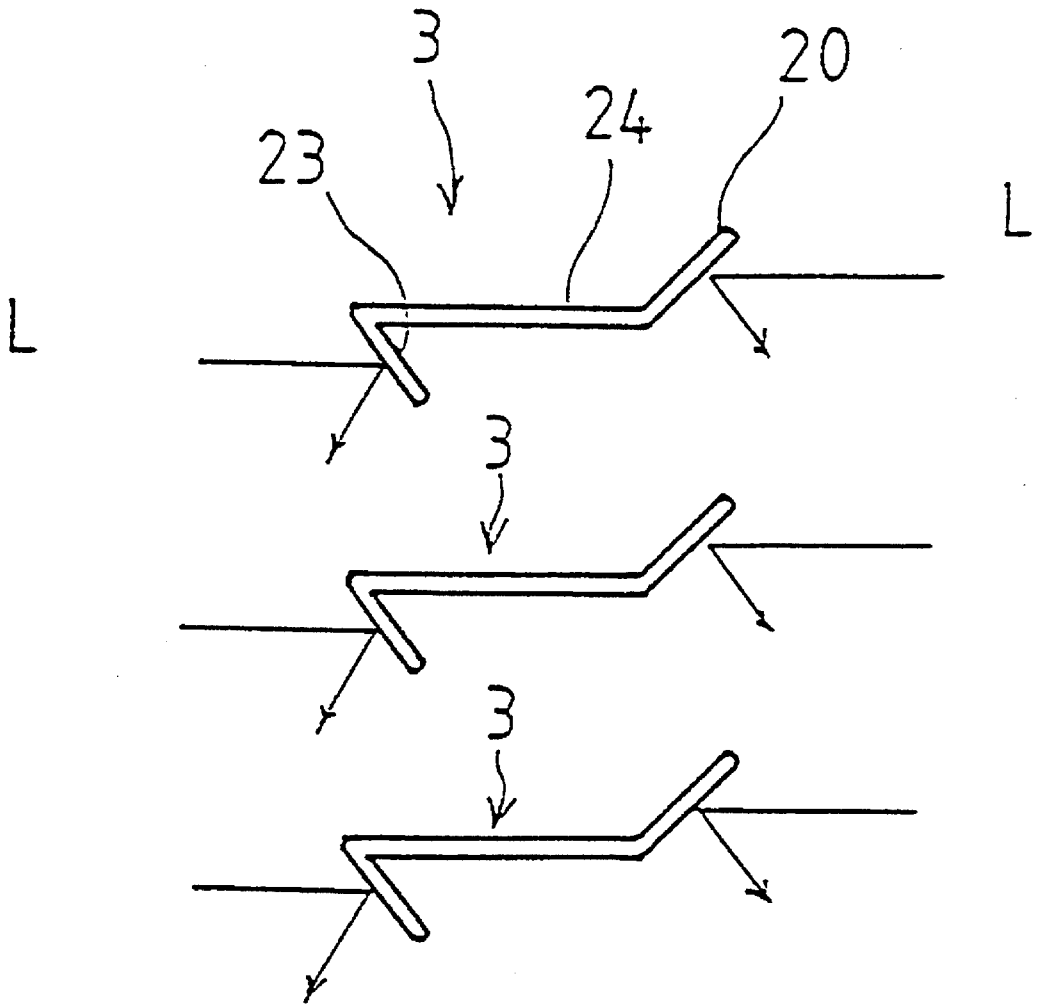
FIG. 23 is a side elevational view showing a form of slats of a blind according to a sixth embodiment of the present invention.

FIG. 23 show a sixth embodiment, which is similar to the fourth and fifth embodiments but differs therefrom in that the distal end of the second bent surface 20 of the first and second bent surfaces 20 and 23 of each base board 3*a* is located closer to the center than the junction between the central surface and the second bent surface. Other details are substantially the same as those of the fourth and fifth embodiments, and will not be described in further detail.

This embodiment can also create an excellent interior atmosphere with a significant graphic pattern 18. According to the arrangement of this embodiment, even when the light, especially light (L) from interior electric lamps, is thrown on the blind surface 17, either on the face or back of the blind 1, the light reflected by the bent surface 20 or 23 of each slat 3 is always directed downwardly, and does not enter the eyes of the observer. Consequently, irrespective of whether the observer is on the face or back side of the blind 1, the light reflected by the surface of the base boards 3*a* will not enter the eyes of the observer, so that the significant graphic pattern 18 is not impaired, when the significant graphic pattern 18 is appearing as the direct-type. The above function and effects cannot be achieved by the arrangement disclosed in Japanese patent application No. 82-239948 (Japanese laid-open patent publication No. 84-83795).

While the present invention has been described above with respect to the embodiments, the present invention is not limited to the illustrated specific arrangements. For example, the base board 3*a* of a slat 3 may be a semitransparent base board or a colored semitransparent base board. The blind 1 according to the present invention can effectively be used in an interior space with a light source placed behind, besides the windowside use. The blind 1 may also be suspended along a wall surface for use only as a direct-type blind.

I claim:

1. A blind having parallel slats angularly movable simultaneously about their respective longitudinal axes, wherein each slat has a graphic pattern forming region on a base board of transparent material, said base board having, in a cross-section transverse to a longitudinal axis thereof, a central surface, a first bent surface bent obliquely upward from one edge of the central surface, and a second bent surface bent obliquely downward from the other edge, said graphic pattern forming regions of the respective slats are arranged to be combined with each other to produce a significant graphic pattern on the entire blind when the slats are angularly moved and tilted to a predetermined angle which is siqnificant for an observer, each of said graphic pattern forming regions comprising a diffused-reflection surface composed of fine irregularities on at least a portion of at least one of the first and second bent surfaces of the base board.

2. A blind according to claim 1, wherein each of said first and second bent surfaces comprises a transparent pouched double-wall portion with an open side end, and a graphic pattern piece having a shape corresponding to a graphic pattern forming region which is to be borne by each of said first and second bent surfaces, is removably inserted into the pouched double-wall portion.

3. A blind according to claim 2, wherein said base board comprises a flattened tubular member.

4. A blind according to claim 1, wherein each of said first and second bent surfaces comprises a transparent pouched double-wall portion with an open side end, and an insert of a transparent base board having a graphic pattern forming region which is to be borne by each of said first and second bent surfaces, is removably inserted into the pouched double-wall portion.

5. A blind according to claim 4, wherein said base board comprises a flattened tubular member.

6. A blind having parallel slats angularly movable simultaneously about their respective longitudinal axes, wherein each slat has a graphic pattern forming region on a base board of transparent material, said base board having, in a cross-section transverse to a longitudinal axis thereof, a central surface, a first bent surface bent obliquely upward from one edge of the central surface, and a second bent surface bent obliquely downward from the other edge, said graphic pattern forming regions of the respective slats are combined with each other to produce a significant graphic pattern on the entire blind when the slats are angularly moved and tilted to a predetermined angle which is significant for an observer, each of said graphic pattern forming regions comprising a highlighted surface for blocking and strongly reflecting the light on at least a portion of at least one of the first and second bent surfaces of the base board.

7. A blind according to claim 6, wherein each of said first and second bent surfaces comprises a transparent pouched double-wall portion with an open side end, and a graphic pattern piece having a shape corresponding to a graphic pattern forming region which is to be borne by each of said first and second bent surfaces, is removably inserted into a pouched-wall portion.

8. A blind according to claim 7, wherein said base board comprises a flattened tubular member.

9. A blind according to claim 6, wherein each of said first and second bent surfaces comprises a transparent pouched double-wall portion with an open side end, and an insert of a transparent base board having a graphic pattern forming region which is to be borne by each of said first and second bent surfaces, is removably inserted into the pouched double-wall portion transparent base board.

10. A blind according to claim 9, wherein said base board comprises a flattened tubular member.

11. A blind having parallel slats angularly movable simultaneously about their own longitudinal axes, wherein each slat has a graphic pattern forming region on a base board of transparent material, said base board having, in a cross section transverse to the longitudinal axis thereof, a central surface, a first bent surface bent obliquely upward from one edge of the central surface, and a second bent surface bent obliquely downward from the other edge, the graphic pattern forming regions of the respective surfaces produce a significant graphic pattern for an observer when the slats are angularly moved and tilted to a predetermined angle, said second bent surface having a distal edge closer to a center than the junction between said central surface and said second bent surface.

12. A blind according to claim 11, wherein each of said first and second bent surfaces comprises a transparent pouched double-wall portion with an open side end, and a graphic pattern piece having a shape corresponding to a graphic pattern forming region which is to be borne by each of said first and second bent surfaces, is removably inserted into the pouched double-wall portion.

13. A blind according to claim 12, wherein said base board comprises a flattened tubular member.

14. A blind according to claim 11, wherein each of said first and second bent surfaces comprises a transparent pouched double-wall portion with an open side end, and an insert of a transparent base board having a graphic pattern forming region which is to be borne by each of said first and second bent surfaces, is removably inserted into the pouched double-wall portion transparent base board.

15. A blind according to claim 14, wherein said base board comprises a flattened tubular member.

16. A blind having parallel slats angularly movable simultaneously about their respective longitudinal axes, wherein each slat has opposite slat edges and a graphic pattern forming region on a base board of transparent material, said base board having, in a cross-section transverse to the longitudinal axis thereof, a central surface having two sides and two defining edges, a first bent surface projecting substantially perpendicularly from one side and along one defining edge of said central surface, and a second bent surface projecting substantially perpendicularly from the other side and along the other defining edge of said central surface, the graphic pattern forming regions comprising the respective bent surfaces which cooperate to produce a significant graphic pattern for an observer when the slats are angularly moved and tilted to a predetermined angle.

17. A blind according to claim 16, wherein each of said first and second bent surfaces comprises a transparent pouched double-wall portion with an open side end, and a graphic pattern piece having a shape corresponding to a graphic pattern forming region which is to be borne by each of said first and second bent surfaces, is removably inserted into the pouched double-wall portion.

18. A blind according to claim 17, wherein said base board comprises a flattened tubular member.

19. A blind according to claim 16, wherein each of said first and second bent surfaces comprises a transparent pouched double-wall portion with an open side end, and an insert of a transparent base board having a graphic pattern forming region which is to be borne by each of said first and second bent surfaces, is removably inserted into the pouched double-wall portion of transparent.

20. A blind according to claim 19, wherein said base board comprises a flattened tubular member.

21. A blind according to claim 1, wherein the significant graphic pattern is projected onto a floor or wall surface when the light coming from behind the blind is blocked by the graphic pattern forming regions.

22. A blind according to claim 1, wherein the significant graphic pattern is observed when the light coming from a front side of the blind is reflected by the graphic pattern forming regions.

* * * * *

UNITED STATES PATENT AND TRADEMARK OFFICE

CERTIFICATE OF CORRECTION

PATENT NO. : 5,558,146
DATED : Sep. 24, 1996
INVENTOR(S) : Makio Abe

It is certified that error appears in the above-identified patent and that said Letters Patent is hereby corrected as shown below:

Please delete columns 1-14 and substitute columns 1-16 as per attached

Signed and Sealed this

Tenth Day of February, 1998

*Attest:*

Bruce Lehman

BRUCE LEHMAN

*Attesting Officer*

*Commissioner of Patents and Trademarks*

BLIND

TECHNICAL FIELD

The present invention relates to a blind for use as an interior article having an element for providing an excellent interior atmosphere.

BACKGROUND ART

Blinds originally serve the purpose of adjusting or blocking the rays of light which are introduced through a building opening into an interior. To meet a demand for a comfortable residential space, blinds are also required to have an element for providing a better interior atmosphere as well as the functions to adjust and block the light. Thus, various ideas have been put to practice in such a way as reducing the width of slates for giving a light visual impression or coloring the slats with soft quiet hues, but all such efforts have not brought satisfactory results.

With presently available blinds, much importance is attached to the functions to adjust and block the light, and slats are made of light-shielding materials such as a light alloy. Therefore, even if slats have soft colors, they look dark as long as viewed from the interior space in the daytime, thereby reducing the effect of the intended interior atmosphere.

Furthermore, conventional blinds are utterly lacking in any technical idea for positively utilizing daylight to provide an excellent atmosphere in the interior space. The applicant has proposed in Japanese patent application No. 62-239948 (Japanese laid-open patent publication No. 64-83795) a blind which positively utilizes daylight to provide an excellent atmosphere in the interior space, without impairing the original functions of the blind to adjust and block the light.

The proposed blind has parallel slats angularly movable simultaneously about their own longitudinal axes, each slat having a graphic pattern forming region on a base board of transparent material. The base board has, in its cross section perpendicular to the longitudinal axis thereof, a central surface, a first bent surface bent obliquely upward from one edge of the central surface, and a second bent surface bent obliquely downward from the other edge. When the slats are angularly moved and tilted at a predetermined angle, the graphic pattern forming regions of the respective slats are combined with each other to produce a significant graphic pattern for an observer on the entire blind.

The graphic pattern forming region is a region formed of a light-shielding paint or film, and the significant graphic pattern is a graphic pattern which is formed on the entire blind when the graphic pattern forming regions of individual slats are combined to give the observer in the interior space some impression through the visual sensation. Such graphic patterns include a pattern formed by the projected light from behind the blind onto the floor or wall (projection type), and a pattern formed on the entire blind by the reflected light from graphic pattern forming regions (direct-type) direct viewing type.

However, the above proposed blind has the following problems to be solved:

When the significant graphic pattern produced by the graphic pattern forming regions on the base boards of the slats has disappeared as the blind is closed, an insignificant pattern, or a pattern which may be uncomfortable to some people, may be formed by the graphic pattern forming regions, making the interior atmosphere uncomfortable rather than improving it.

Since the graphic pattern forming regions are fixed to the slat base boards, when the user is bored with the significant graphic pattern which is produced, the user has no choice other than replacing the blind as a whole. This poses a problem when the user wants to change the interior atmosphere depending on the type of the guests or the change of season.

DISCLOSURE OF THE INVENTION

It is an object of the present invention to provide a blind which positively utilizes transmission or reflection (diffused reflection and total reflection) of the light for creating a fresh interior atmosphere which conventional blinds are unable to produce without hindering its functions to adjust and block the light.

The above object includes an object to make substantially inconspicuous the graphic pattern forming regions on the base boards of the slats when a significant graphic pattern is disappeared while the blind is closed.

The above object also includes an object to enable a significant graphic pattern produced by the graphic pattern forming regions on the base boards of the slats to be changed without replacing the blind.

The above object also includes an object to prevent a significant graphic pattern produced for direct viewing from being disturbed by excessive reflection of the light from the surfaces of the base boards of the slats.

Other objects of the present invention are apparent from the following description and "BEST MODE FOR CARRYING OUT THE INVENTION" given below.

To achieve the above objects, an aspect of the present application is arranged as follows:

A blind has parallel slats which are angularly movable simultaneously about their own longitudinal axes;

each slat has a graphic pattern forming region on a base board of transparent material;

the base board has, in its cross section transverse to the longitudinal axis thereof, a central surface, a first bent surface bent obliquely upward from one edge of the central surface, and a second bent surface bent obliquely downward from the other edge;

the graphic pattern forming regions of the respective slats are arranged so that when the slats are angularly moved and tilted at a predetermined angle so that the central surface is oriented along a line-of-sight of the observer, they are combined with each other to produce a significant graphic pattern for an observer on the entire blind; and each of the graphic pattern forming regions comprises a diffused-reflection surface composed of fine irregularities on a portion of a surface of the base board.

In the blind of the above-described arrangement, when the slats are turned at a predetermined angle, the graphic pattern forming regions thereof are combined with each other to form a light-shielding portion (projection type) or a reflecting portion (direct-type) for diffused reflection, thereby producing on the entire blind a graphic pattern which is significant for the observer. The significant graphic pattern creates an excellent interior atmosphere. The light-shielding portion blocks the light coming from behind the blind and forms a shadow on a wall or floor (projection). The reflecting portion for diffused reflection reflects the light coming from the side of the observer, thereby enabling the observer to recognize the graphic pattern.

The predetermined angle for the slats is an angle at which the significant graphic pattern appears most clearly on the blind surface due to reflection, or an angle at which the significant graphic pattern appears most clearly on a wall or floor by projection. This angle is set to a suitable value depending on the direction of the observer's eyes or the direction of the light coming from the side of the interior (the side of the observer) or the side of the outdoors.

Since the graphic pattern forming regions comprise the diffused-reflection surfaces composed of fine irregularities provided on a portion of a surface of the base board, a clear image is projected onto the wall or floor by the light transmitted from behind the blind. As the light reflected by these surfaces is of soft white color, so that the graphic pattern forming regions are not so conspicuous while the significant graphic pattern has disappeared with the blind closed. Consequently, the interior atmosphere is not spoiled even when the significant graphic pattern has disappeared from the blind.

To achieve the above objects, another aspect of the present application is arranged as follows:

A blind has parallel slats which are angularly movable simultaneously about their own longitudinal axes;

each slat has a graphic pattern forming region on a base board of transparent material;

the base board has, in its cross section transverse to the longitudinal axis thereof, a central surface, a first bent surface bent obliquely upward from one edge of the central surface, and a second bent surface bent obliquely downward from the other edge;

the graphic pattern forming regions of the respective slats are arranged so that when the slats are angularly moved and tilted at a predetermined angle, they are combined with each other to produce a graphic pattern on the entire blind which is significant for the observer; and each of the graphic pattern forming regions comprises a highlighted surface for blocking and strongly reflecting the light, on a portion of a surface of the transparent base board.

In the blind of the above-described arrangement, when the slats are turned at a predetermined angle, the graphic pattern forming regions thereof are combined with each other to produce a significant graphic pattern. When the blind is viewed in the direct viewing type, the significant graphic pattern is formed by a dark portion behind the blind against a background of a bright portion provided by the highlighted surface. When the blind is viewed in the projection type, the significant graphic pattern is formed on a wall or floor by the transmitted light. In this case, the graphic pattern is an image in which the bright and dark areas of the graphic pattern are reversed to those of the image on the direct viewing type, thereby creating an excellent interior mood.

The significant graphic pattern (direct-type) produced by highlighted graphic pattern forming area looks as a raised bright graphic pattern against a dark background, since the back surface of the blind is darker than the surface on the side of the observer, thereby developing a unique but a significant graphic pattern to create an interior atmosphere different from the significant graphic pattern produced by the diffused reflection (also in the direct viewing type).

To achieve the above objects, still another aspect of the present application is arranged as follows:

A blind has parallel slats which are angularly movable simultaneously about their own longitudinal axes:

each slat has a graphic pattern forming region on a base board of transparent material;

the base board has, in its cross section transverse to the longitudinal axis thereof, a central surface, a first bent surface bent obliquely upward from one edge of the central surface, and a second bent surface bent obliquely downward from the other edge;

the graphic pattern forming regions of the respective slats are arranged so that when the slats are angularly moved and tilted at a predetermined angle, the graphic pattern forming regions of the respective slats are combined with each other to produce a significant graphic pattern for an observer on the entire blind; and the second bent surface has a distal edge closer to a center than the junction between the central surface and the second bent surface.

In the blind of the above-described arrangement, when the slats are turned at a predetermined angle, the graphic pattern forming regions thereof are combined with each other to form a light-shielding portion (projection type) or a reflecting portion (direct-type), and the blind as a whole provides a graphic pattern which is significant for the observer. The significant graphic pattern creates an excellent interior atmosphere. The significant graphic pattern is formed by a projection in which the light from behind the blind is blocked by the graphic pattern forming regions or a reflection (diffused reflection, total reflection) from the graphic pattern forming regions on the blind.

The distal edge of the second bent surface is set closer to the center than the junction between the central surface and the second bent surface. Therefore, when the slats are turned about their longitudinal axes in a direction to elevate the first bent surfaces and lower the second bent surfaces to close the blind, the light from the side of the observer to the blind is reflected by the base board surface other than the graphic pattern forming regions of the slats, which are not viewed by the observer, irrespective of which side of the blind faces the observer. Thus, when the significant graphic pattern is produced in the direct-type, the graphic patterns can be prevented from being disturbed by the excessive light reflected from the base board surface.

To achieve the above objects, a further aspect of the present application is arranged as follows:

A blind has parallel slats which are angularly movable simultaneously about their own longitudinal axes;

each slat has a graphic pattern forming region on a base board of transparent material;

the base board has, in its cross section transverse to the longitudinal axis thereof, a central surface, a first bent surface projecting substantially perpendicularly upward from an edge on one side of the central surface, and a second bent surface projecting substantially perpendicularly downwardly from the other edge on an opposite side of the central surface;

the graphic pattern forming regions of the slats are arranged so that when the slats are angularly moved and tilted at a predetermined angle, the graphic pattern forming regions of the surfaces produce a graphic pattern which is significant for the observer.

In the blind of this arrangement too, when the slats are turned at a predetermined angle, the graphic pattern forming regions thereof are combined with each other to form a light-shielding portion (projection type) or a reflecting portion (direct-type), thereby producing a graphic pattern which is significant for the observer. This significant graphic pattern creates an excellent interior atmosphere. The significant graphic pattern is formed by a projection in which the light from behind the blind is blocked by the graphic pattern forming regions or by a reflection from the graphic pattern forming regions on the blind.

Since the first and second bent surfaces project substantially perpendicularly upward from the central surface, the width of the slat (a dimension in a direction normal to the longitudinal axes thereof) can be reduced, and the resistance against bending is increased for each slat.

To achieve the above objects, another aspect according to the present application is accomplished by adding the following arrangements to the above aspects:

Each of the first and second bent surfaces comprises a transparent pouched double-wall portion with an open side end, and a graphic pattern piece having a cut-out shape corresponding to a graphic pattern forming region which is to be borne by each of the first and second bent surfaces, is removably inserted into the pouched double-wall portion.

When the graphic pattern pieces are moved in the pouched double-wall portions or replaced, the combinations with the graphic pattern forming regions of the other slats are varied, thus varying a projection produced by the entire blind to be viewed by the observer or the significant graphic pattern produced in the direct type.

The significant graphic pattern produced by the graphic pattern forming regions of the slats can thus be varied without replacing the blind, so that an appropriate interior atmosphere can be created depending on the type of the guests or the season.

To achieve the above objects, still another aspect according to the present application is accomplished by adding the foillowing arrangements to the above inventions:

Each of the first and second bent surfaces comprises a transparent pouched double-wall portion with an open side end, and an insert of a transparent base board having a graphic pattern forming region which is to be borne by each of the first and second bent surfaces, is removably inserted in the pouched double-wall portion.

When the inserts are moved in the pouched double-wall portions or replaced, the combinations with the graphic pattern forming regions of the other slats are varied, thus varying a projection produced by the entire blind to be viewed by the observer or the significant graphic pattern produced by the direct-type blind. In this case, since the insert comprises a base board having a graphic pattern forming region, which is to be borne by the first and second bent surfaces, the insert can smoothly and easily be moved in the pouched double-wall portion.

The significant graphic pattern produced by the graphic pattern forming regions of the slats can thus be varied without replacing the blind, so that an appropriate interior atmosphere can be created depending on the type of the guests or the season.

To achieve the above objects, yet still another aspect according to the present application is accomplished by adding the following arrangements to the above aspects:

The base board comprises a flattened tubular member. The tubular member includes those ranging from a tube having a completely closed cross section to one having an unclosed ring-shaped cross section with a cut-out.

This structure enables the pouched double-wall portion to be easily produced.

In each of the above aspects, when the blind is closed, the slats are turned into overlapping condition in which they block the light, and when the blind is open, the slats lie horizontally, giving a maximum opening as viewed from the front side of the blind.

BRIEF DESCRIPTION OF THE DRAWINGS

Figure 2:
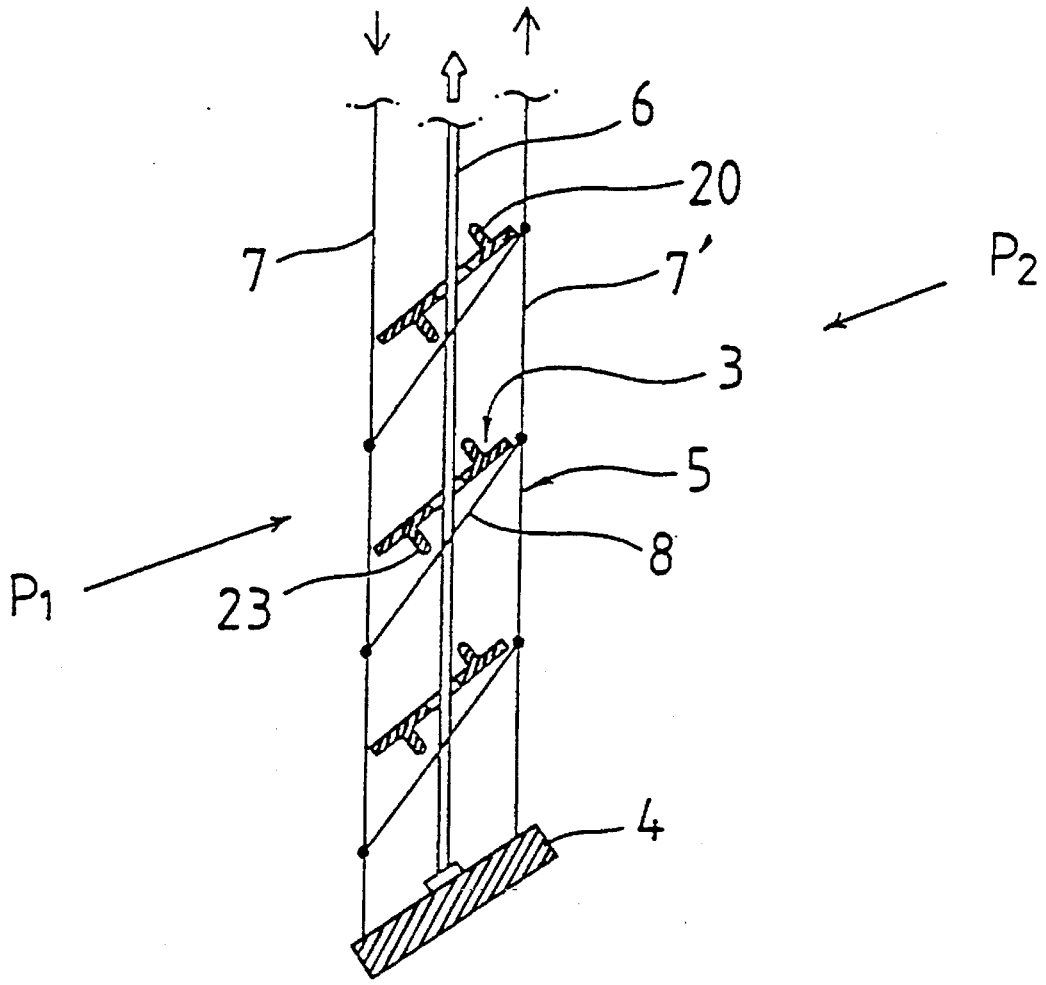
FIG. 2 is a fragmentary cross-sectional view the principal part of the blind according to the first embodiment.
Figure 5:
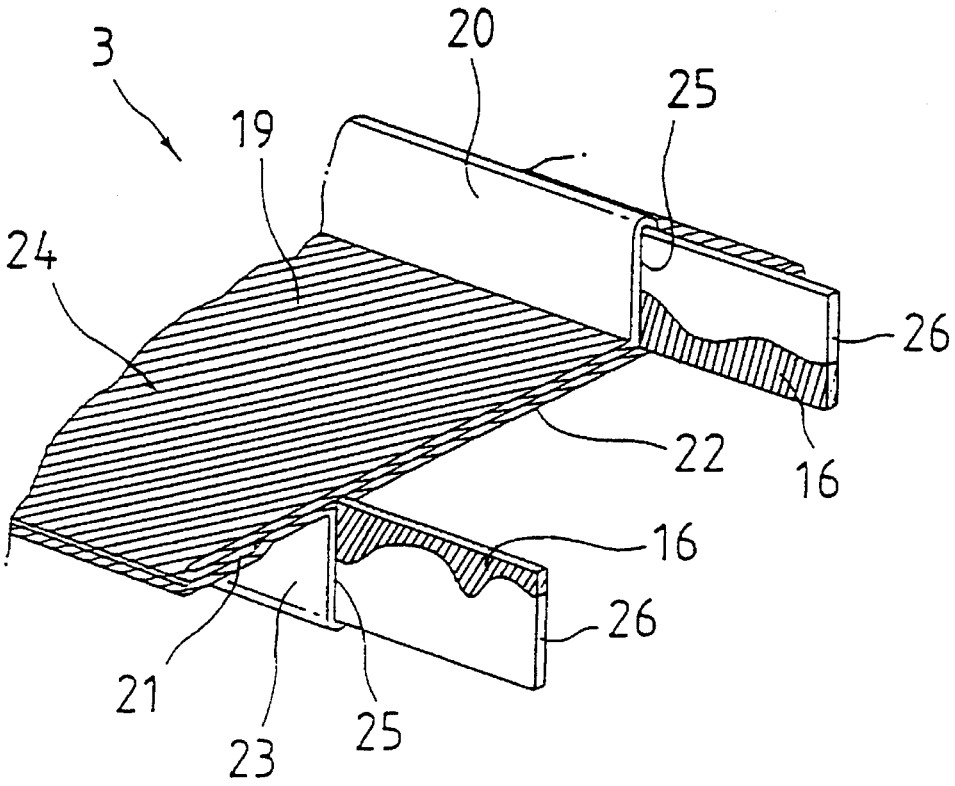
FIG. 5 is a fragmentary perspective view showing the principal part of a slat of the blind according to the first embodiment.
Figure 16:
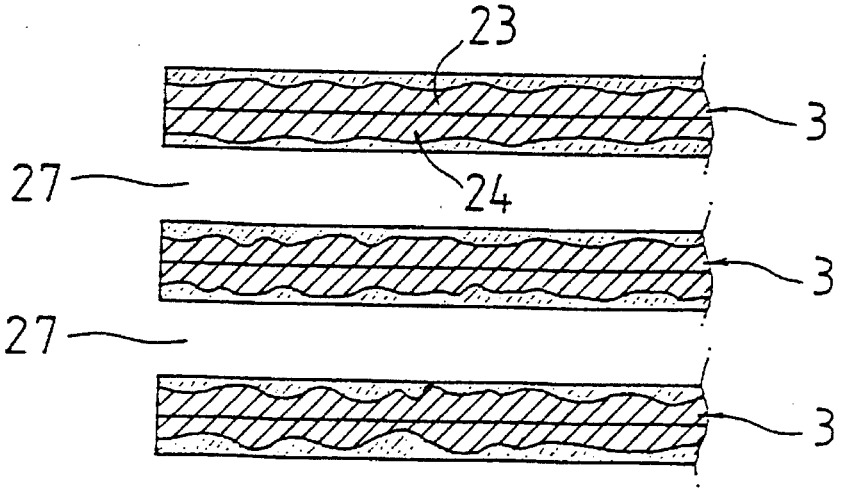

FIG. 1 is a perspective view of a blind according to a first embodiment of the present invention;

FIG. 2 is a fragmentary cross-sectional view the principal part of the blind according to the first embodiment;

FIG. 3 is a front elevational view of the blind according to the first embodiment with a significant graphic pattern appearing;

FIG. 4 is a side elevational view of a slat of the blind according to the first embodiment;

FIG. 5 is a fragmentary perspective view showing the principal part of a slat of the blind according to the first embodiment;

Fig. 6 is a fragmentary side elevational view of principal part showing the slats tilted at a predetermined angle in the blind according to the first embodiment;

FIG. 7 is a fragmentary front elevational view of principal part showing the slats tilted at the predetermined angle in the blind according to the first embodiment;

FIG. 8 is a fragmentary side elevational view showing the principal part of the blind according to the first embodiment when the blind is closed;

FIG. 9 is a fragmentary front elevational view of the principal part of the blind according to the first embodiment when the blind is closed;

FIG. 10 is a side elevational view showing a condition of a material of which the slats of blind according to the first embodiment are made;

FIG. 11 is a cross-sectional view of a slat of a blind according to a second embodiment of the present invention;

FIG. 12 is fragmentary perspective view of the principal part of the slat of the blind according to a second embodiment of the present invention;

FIG. 13 is a fragmentary side elevational view of the principal part of the slats tilted at a predetermined angle in the blind according to the second embodiment;

FIG. 14 is a fragmentary front elevational view of the principal part of the slats tilted at the predetermined angle according to the second embodiment;

FIG. 15 is a fragmentary side elevational view of the principal part ofthe blind according to the second embodiment when the blind is fully open;

Fig. 16 is a fragmentary front elevational view of the principal part of the blind according to the second embodiment when the blind is-fully open;

FIG. 17 is a fragmentary side elevational view of the principal part of the blind according to the second embodiment when the blind is fully closed;

FIG. 18 is a fragmentary front elevational view of the principal part of the blind according to the second embodiment when the blind is fully closed;

FIG. 19 is a side elevational view showing a condition of a material of the blind according to the second embodiment are made;

FIG. 20 is a fragmentary perspective view of the principal part of the slat of a blind according to a third embodiment of the present invention;

FIG. 21 is a fragmentary perspective view of the principal part of a slat of a blind according to a fourth embodiment of the present invention;

FIG. 22 is a fragmentary perspective back view of the principal part of a slat of a blind according to a fifth embodiment of the present invention; and FIG. 23 is a side elevational view showing a form of slats of a blind according to a sixth embodiment of the present invention.

BEST MODE FOR CARRYING OUT THE INVENTION

Embodiments of the present invention will hereinafter be described in detail with reference to the drawings.

FIGS. 1 through 10 show a first embodiment of the present invention.

A blind 1 has a number of slats 3 and a lower plate 4, which serves as a weight, attached to a lower surface of a storage box 2 by laterally spaced ladder cords 5 and a lift cord 6.

The ladder cords 5, which takes a ladder form as a whole (FIG. 2), include lateral cords 8 attached at constant intervals between front and rear vertical cords 7 and 7', the front vertical cord 7 facing the observer. The ladder cords 5 have upper ends mounted on a turning device 9 housed in the storage box 2, and lower ends fixed to the lower plate 4. The slats have opposite ends placed on the respective lateral cords 8. The turning device 9 can be turned by a slat turning control cord 10.

The lift cords 6 extend through the opposite ends of the slats 3 without being restricted thereby. The lift cords 6 have upper ends attached to a winding device 11 housed in the storage box 2, and lower ends secured to the lower plate 4. The winding device 11 can be turned by a blind lifting/lowering cord 12.

When the blind lifting/lowering cord 12 is operated in a direction to lift the blind 1, the lift cords 6 are wound by the winding device 11, and the blind 1 is lifted so that lower slats 3 move closer to and underlie upper slats 3, whereby the blind 1 is fully wound up. When the blind lifting/lowering cord 12 is operated in a direction to lower the blind 1, the blind 1 is unwound to allow the lower plate 4 to move downward by gravity, while the lower slats 3 are moved away from upper slats 3 to be released gradually from the mutually stacked relationship, thereby allowing to blind 1 extend downward.

When the slat turning control cord 10 is operated, the vertical cords 7 and 7', of the front and rear sides with respect to the observer, move in opposite upper and lower directions respectively, thereby varying the inclination of the lateral cords 8 to cause each of the slats 3 to turn simulated neously about its longitudinal axis from a fully open condition to a fully closed condition. According to the present invention, furthermore, there exists a condition in which each of the slat 3 is tilted at a predetermined angle with respect to a direction P1 along which the observer views the blind 1 and a direction P2 along which light is introduced from behind the blind 1, between the fully open condition and the fully closed condition.

Each of the turning devices 9 and the winding device 11 has a friction stop or click stop mechanism for keeping the slats 3 or the blind 1 at a desired turned or wound position.

The fully open condition is a condition in which the slats 3 lie substantially parallel to each other with a maximum distance therebetween. The fully closed condition is a condition in which the slats 3 lie substantially vertically and overlap each other. The condition in which the slats 3 are tilted at a predetermined angle is a condition in which the blind 1 as a whole produces a significant graphic pattern, for example a graphic pattern 18 representing the image of two smiling women, as shown in FIG. 3. Such significant graphic pattern 18 is a graphic pattern which is produced on a blind surface 17 by combining the graphic pattern forming regions 16 of slats 3, and which gives the observer in the interior space some impression through the visual sensation.

As shown in FIG. 4, each of the slats 3 comprises a base board 3a which is made from a belt-shaped acetate sheet (or a transparent sheet of other synthetic resin). The acetate sheet is folded back to form upper and lower layers along its longitudinal axis, thereby providing a base board 3a. The base board 3a is bent upward substantially at a right angle near a folded end of an upper surface portion 19 and then bent back downwardly, thereby providing a first bent surface portion 20. The first bent surface portion 20 comprises a hollow narrow pouched double-wall portion with an open side end. The other end of the upper surface portion 19 is bent back toward a lower surface of the base board 3a, providing a bent-back portion 21. The lower surface portion 22 of the base board 3a is formed by folding back the upper surface portion 19, and is bent downward substantially at a right angle near the other end and then bent back upwardly, thereby providing a second bent surface portion 23. The lower surface portion 22 has a distal end underlying the lower surface of the bent-back portion 21 of the upper surface portion 19. The second bent surface portion 23 also comprises a hollow narrow pouched double-wall portion with an open side end. The upper surface portion 19, the lower surface portion 22, and the bent-back portion 21 except the first and second bent surface portions 20 and 22 are bonded together by an adhesive or the like. The first and second bent surface portions 20 and 23 are joined to each other by a central surface 24.

Inserts 26 which comprise a belt-shaped acetate sheet (or a transparent sheet of other synthetic resin) are removably inserted from insertion slots 25 into the first and second bent surface portions 20 and 23, each comprising a hollow narrow pouched double-wall portion.

Each of the slats 3 has a graphic pattern forming region 16 on its transparent base board 3a, the graphic pattern forming region 16 producing a graphic pattern by blocking or reflecting light. "Blocking light" is a function to block the ray of light from behind the blind 1 for forming (projecting) a shadow on a wall or a floor. "Reflecting light" is a function to reflect the ray of light from the side of the observer as diffused or total reflection to make the observer recognize the graphic pattern forming region 16.

In this embodiment, the inserts 26 removably inserted in the first and second bent surface portions 20 and 23 of the base board 3a, and the central surface 24 are coated with an opaque paint thereby to provide the graphic pattern forming region 16. The central surface 24 is coated on its entire area, and the inserts 26 are coated from portions joining to the central surface 24 toward distal edges thereof, to form coating irregularities. These coating irregularities are meaningless on a single insert 26. However, when the slats 3 are tilted at a predetermined angle, the graphic pattern forming regions 16 on the slats 3 are combined with each other to produce the significant graphic pattern 18 on the overall blind. In actual case, an attractive portrait photograph (black and white) of a person, for example, is divided into a number of horizontal strips and the black or white portion on each strip is transferred as a graphic pattern forming region 16 onto a transparent board.

As shown in FIG. 6, when the slats 3 are tilted so that the central surfaces 24 lie parallel to the direction P1 of the observer's eyes, the first and second bent surfaces 20 and 23 are erected substantially perpendicularly to the direction P1, permitting the graphic pattern forming regions 16 on the inserts 26 to be viewed from the front side of the blind.

Thus, the graphic pattern forming regions 16 on the slats 3 are seen as viewed in FIG. 7. On the blind surface 17 as a whole, the entire graphic pattern forming regions 16 are combined to produce the significant graphic pattern 18 as shown in FIG. 3.

The significant graphic pattern 18 appears when a shadow produced by blocking the light P1 from behind the blind with the graphic pattern forming regions 16 is recognized by the observer (direct-type). The shadow may be projected onto a wall or floor, and recognized by the observer (projection type). In addition, when no light comes from behind the blind during night or the like, the light from the side of the observer, i.e., the light from an interior lamp, may be reflected by the graphic pattern forming regions 16 (diffused reflection), and recognized by the observer (direct-type).

When the inserts 26 in the respective slats 3 are replaced, the position or size of the graphic pattern forming regions 16 on the first and second bent surfaces 20 and 23 is varied, thereby enabling the appearing significant graphic pattern 18 to be varied. Thus, the significant graphic pattern 18 can be varied without replacing the whole of the blind 1.

Depending on the graphic pattern, the same inserts 26 may be use for changing the graphic pattern by simply changing their positions in the first and second bent surfaces 20 and 23. This holds true for both the direct-type and the projection type.

In FIG. 6, the direction P1 is set to a horizontal direction, so that the angle at which the slats 3 are tilted is a predetermined angle for allowing the significant graphic pattern 18 to appear, as well as an angle for an open condition in which the greatest gaps 27 are provided between the slats 3.

When the slats 3 are turned across the direction P1 of the observer's eyes until the upper and lower edges thereof overlap each other, the blind 8 is closed as shown in FIG. 8. In this condition, as shown in FIG. 9, the graphic pattern forming regions 16 on the inserts 24 in the first and second bent surfaces 20 and 23, and the central surface 24 are joined, and the significant graphic pattern 18 disappears, with the blind surface 17 blocking the light as a whole.

As described above, by adjusting the angle of the slats 3 of the blind 1, the significant graphic pattern 18 appears on the blind surface 17 thereby creating an excellent atmosphere in an interior space. The atmosphere thus created is highly effective in both the space at home and the space for business.

In the first embodiment, acetate sheets are bonded into two layers as the base board 3*a*, and the first and second bent surfaces 20 and 23 are formed to serve as stiffening ribs of the slats 3, thereby increasing their mechanical strengths to reduce the fear of bending or breakage.

The significant graphic pattern 18 which appears on the blind surface 17 may be replaced with one suitable for a desired interior atmosphere simply by replacing the inserts 26 inserted into in the first and second bent surfaces 20 and 23 with those having other graphic pattern forming regions 16 or by adjusting the position of the inserts 26 in the first and second bent surfaces 20 and 23.

The base board 3*a* may be other transparent synthetic resin sheet such as a vinyl chloride sheet than the acetate sheet. As shown in FIG. 10, the base board 3*a* can also be formed at a time by inwardly pressing with heat a material 3*b* (having a ring-shaped cross section with a cutout). To form pouched double-wall portions of the first and second bent surfaces 20 and 23, a core is inserted therinto in advance.

Besides coating with a paint or printing, the graphic pattern forming regions 18 may be produced by attaching paper or metal foil, or by applying sand to provide a diffused reflection surface with fine irregularities on the surface of the base board.

Substantially the same effect can be obtained by forming only one of the first and second bent surfaces 20 and 23 into a pouched double-wall portion. For the other bent surface which does not comprise a pouched double-wall portion, a graphic pattern forming region 16 is formed directly on the surface of the base board 3*a*.

FIG. 11 shows a slat 3 of a blind according to a second embodiment of the present invention. A base board 3*a* is formed with a hard vinyl chloride sheet. The base board 3*a* has a central surface 24, a first bent surface 20 bent obliquely upward at an angle of about 45° from a rear end of the central surface 24 and having a width which is about a half of the width of the central surface 24, and a second bent surface 23 bent obliquely downward at an angle of about 45° from a front end of the central surface 24 and having a width which is about a half of the width of the central surface 24. That is, the base board 3*a* has an elongated Z- or S-shaped cross section perpendicular to the longitudinal axis of the slat 3.

The first and second bent surfaces 20 and 23 comprise pouched double-wall portions formed by folding back the sheet. Inserts 26 each made of a transparent vinyl chloride sheet are removably inserted into the pouched double-wall portions (FIG. 12). Light-shielding colored paper sheets are attached to the central surface 24 of the transparent base board 3*a* and the inserts 26, thereby forming graphic pattern forming regions 16.

The other details of the blind 1 according to the second embodiment are substantially the same as those of the first embodiment, and will not be described below.

In FIG. 13, the slats 3 are partly open with the central surfaces oriented at a predetermined angle with respect to the direction P1 along a line-of-sight of the observer's eyes or the direction P2 along which light is introduced from behind the blind 1. In this condition, the graphic pattern forming regions 16 on the first and second bent surfaces 20 and 23 rise at a suitable angle with respect to the direction P1 or P2, and hence can be observed or projected with a certain area and a clear outline as shown in FIG. 14. As a result, the graphic pattern forming regions 16 are combined with each other, producing a significant graphic pattern 18 on the blind surface 17. As in the case of the first embodiment, the significant graphic pattern 18 is recognized by the observer by being directly viewed or projected onto the wall or floor, thereby producing an excellent interior atmosphere.

FIG. 15 shows the blind 1 as it is fully open with the slats 3 tilted so that the central surfaces 24 are inclined at an angle of about 22.5° to the direction P1 or P2. In this case, the graphic pattern forming regions 16 on the inserts 26 in the first and second bent surfaces 20 and 23 overlap each other with respect to the direction P1 (FIG. 16), thereby preventing the significant graphic pattern 18 from appearing on the blind surface 17. The gaps 27 between the slats 3 become maximum.

FIG. 17 shows the blind 1 according to the second embodiment which is fully closed. When the slats 3 are erected across the direction P1, and the graphic pattern forming regions 16 on the slats 3 overlap each other. The light from the exterior is blocked substantially completely as shown in FIG. 18.

In the second embodiment, the angles of the first and second bent surfaces 20 and 23 with respect to the central surface 24 of the slat 3 may be set within the range of 20° to 50° and 200° to 230°, respectively. The ratios between the width of the central surface 24 and the widths of the first and second bent surfaces 20 and 23 are not necessarily limited to those illustrated in the embodiment. It is also possible to provide only one of the first and second bent surfaces 20 and 23 with a pouched double-wall portion.

As shown in FIG. 19, the base board 3*a* can be formed at a time through not-press process by inwardly pressing a tubular or a tube-like material (having a ring-shaped cross section with a cutout). To form pouched double-wall portions of the first and second bent surfaces 20 and 23, a core is inserted thereinto in advance.

The second embodiment is of a structure simpler than that of the first embodiment, but is capable of providing the similar function an effect as the first embodiment. Furthermore, when the blind 1 is wound up, the gaps between the slats 3 are made smaller than those of the first embodiment.

FIG. 20 shows a third embodiment in which inserts 26 used in the first and second embodiments are formed with rigid metal sheets or cut-out paper sheets 16*a* having the outline of graphic pattern forming regions 16, and are removably inserted into the pouched double-wall portions of the first and second bent surfaces 20 and 23. The cut-out sheets 16*a* have integral reinforcing members 16*b* formed by folding them longitudinally. The base board 3*a* of the third embodiment should preferably be of the structure described with reference to FIG. 19.

With this arrangement, the base board 3*a* will not overlap a transparent portion to reduce the absorption and diffusion of light, so that the significant graphic pattern 18 will have a clear profile. Other specific details are the same as those of the first or second embodiment, and will not be described in further detail.

FIG. 21 shows a fourth embodiment, in which the base board 3*a* of a slat 3 is formed by simply bending a single transparent synthetic resin sheet into a central surface 24 and first and second bent surfaces 20 and 23. Sand is blown on the central surface 24 and the first and second bent surfaces 20 and 23 to produce a graphic pattern forming region 16. More specifically, a paper pattern cut corresponding to the shape of the graphic pattern forming region 16 is applied to the surface of the base board 3*a*, and the sand is blown thereon to produce fine irregularities on the surface of the base board 3*a*, which serves as the graphic pattern forming region 16. The graphic pattern forming region 16 thus formed has a soft opalescent color like frosted glass. When exposed to the light applied from behind the blind, it blocks the light because of diffused reflection, producing a clear projected graphic pattern.

Other details are substantially the same as those of the second embodiment, and will not be described in further detail.

The blind according to this embodiment is capable of creating an excellent interior atmosphere with a significant graphic pattern 18 as with the second embodiment. When the blind i is closed causing the significant graphic pattern 18 to disappear from the blind surface 17. the graphic pattern forming region 16 is not so conspicuous as it is opalescent. Thus, the interior atmosphere will not be impaired when the blind 1 is closed.

To make the graphic pattern forming region 16 opalescent, a chemical or electrical embossing technology may be employed besides than the above process.

Functional and effect of this embodiment cannot be obtained by the arrangement disclosed in Japanese patent application No. 62-239948 (Japanese laid-open patent publication No. 64-83795).

FIG. 22 shows a fifth embodiment, in which the base board 3*a* of a slat 3 is formed by simply bending a single transparent synthetic resin sheet into a central surface 24 and first and second bent surfaces 20 and 23. A graphic pattern forming region 16 comprises a highlighted surface for strongly reflecting light, the highlighted surface being formed with a paint mixed with fine glass beads and having a high brightness.

Other details are substantially the same as those of the second embodiment, and will not be described in further detail.

In this embodiment, a significant graphic pattern is formed by the gaps between slats and a dark surface other than the graphic pattern forming region 16 of the slat. Specifically, the highlighted area where light from the side of the observer is strongly reflected serves as a background, and the gaps and the dark surface form a graphic pattern against such a background. When the graphic pattern forming region 16 constitutes a light-shielding highlighted surface with respect to the light from behind the blind, a shadow portion serves as a background during daytime, and a light-transmitting portion and the background form a significant graphic pattern with reversed bright and dark regions on a wall or floor.

The above arrangement is effective to create an excellent interior atmosphere. The above function and effects cannot be achieved by the arrangement of disclosed in Japanese patent application No. 82-239948 (Japanese laid-open patent publication No. 64-83795).

FIG. 23 show a sixth embodiment, which is similar to the fourth and fifth embodiments but differs therefrom in that the distal end of the second bent surface 20 of the first and second bent surfaces 20 and 23 of each base board 3*a* is located closer to the center than the junction between the central surface and the second bent surface. Other details are substantially the same as those of the fourth and fifth embodiments, and will not be described in further detail.

This embodiment can also create an excellent interior atmosphere with a significant graphic pattern 18. According to the arrangement of this embodiment, even when the light, especially light (L) from interior electric lamps, is thrown on the blind surface 17, either on the face or back of the blind 1, the light reflected by the bent surface 20 or 23 of each slat 3 is always directed downwardly, and does not enter the eyes of the observer. Consequently, irrespective of whether the observer is on the face or back side of the blind 1, the light reflected by the surface of the base boards 3*a* will not enter the eyes of the observer, so that the significant graphic pattern 18 is not impaired, when the significant graphic pattern 18 is appearing as the direct-type. The above function and effects cannot be achieved by the arrangement disclosed in Japanese patent application No. 62-239948 (Japanese laid-open patent publication No. 64-83795).

While the present invention has been described above with respect to the embodiments, the present invention is not limited to the illustrated specific arrangements. For example, the base board 3*a* of a slat 3 may be a semitransparent base board or a colored semitransparent base board. The blind 1 according to the present invention can effectively be used in an interior space with a light source placed behind, besides the windowside use. The blind 1 may also be suspended along a wall surface for use only as a direct-type blind.

I claim:

1. A blind having parallel slats angularly movable simultaneously about their respective longitudinal axes, wherein each slat has a graphic pattern forming region on a base board of transparent material, said base board having, in a cross-section transverse to a longitudinal axis thereof, a central surface, a first bent surface bent obliquely upward from one edge of the central surface, and a second bent surface bent obliquely downward from the other edge, said graphic pattern forming regions of the respective slats are arranged to be combined with each other to produce a significant graphic pattern for an observer on the entire blind when the slats are angularly moved so that said central surface is oriented along a line-of-sight of the observer's eyes, each of said graphic pattern forming regions comprising a diffused-reflection surface composed of fine irregularities on at least a portion of at least one of the first and second bent surface of the base board.

2. A blind having parallel slats angularly movable simultaneously about their respective longitudinal axes, wherein each slat has a graphic pattern forming region on a base board of transparent material, said base board having, in a cross-section transverse to a longitudinal axis thereof, a central surface, a first bent surface bent obliquely upward from one edge of the central surface, and a second bent surface bent obliquely downward from the other edge, said graphic pattern forming regions of the respective slats are arranged to be combined with each other to produce a significant graphic pattern for an observer on the entire blind when the slats are angularly moved so that said central surface is oriented along a line-of-sight of the observer's eyes, each of said graphic pattern forming regions comprising a diffused-reflection surface composed of fine irregularities on at least a portion of at least one of the first and second bent surface of the base board, wherein each of said first and second bent surfaces comprises a transparent pouched double-wall portion with an open side end, and a graphic pattern piece having a shape corresponding to a graphic pattern forming region which is to be borne by each of said first and second bent surfaces, is removably inserted into the pouched double-wall portion.

3. A blind according to claim 2, wherein said base board comprises a flattened tubular member.

4. A blind having parallel slats angularly movable simultaneously about their respective longitudinal axes, wherein each slat has a graphic pattern forming region on a base board of transparent material, said base board having, in a cross-section transverse to a longitudinal axis thereof, a central surface, a first bent surface bent obliquely upward from one edge of the central surface, and a second bent surface bent obliquely downward from the other edge, said graphic pattern forming regions of the respective slats are arranged to be combined with each other to produce a significant graphic pattern for an observer on the entire blind when the slats are angularly moved so that said central surface is oriented along a line-of-sight of the observer's eyes, each of said graphic pattern forming regions comprising a diffused-reflection surface composed of fine irregularities on at least a portion of at least one of the first and second bent surface of the base board, wherein each of said first and second bent surfaces comprises a transparent pouched double-wall portion with an open side end, and an insert of a transparent base board having a graphic pattern forming region which is to be borne by each of said first and second bent surfaces, is removably inserted into the pouched double-wall portion.

5. A blind according to claim 4, wherein said base board comprises a flattened tubular member.

6. A blind having parallel slats angularly movable simultaneously about their respective longitudinal axes, wherein each slat has a graphic pattern forming region on a base board of transparent material, said base board having, in a cross-section transverse to a longitudinal axis thereof, a central surface, a first bent surface bent obliquely upward from one edge of the central surface, and a second bent surface bent obliquely downward from the other edge, said graphic pattern forming regions of the respective slats are arranged to be combined with each other to produce a significant graphic pattern for an observer on the entire blind when the slats are angularly moved so that said central surface is oriented along a line-of-sight of the observer's eyes each of said graphic pattern forming regions comprising a highlighted surface for blocking and strongly reflecting the light on at least a portion of at least one of the first and second bent surfaces of the base board.

7. A blind having parallel slats angularly movable simultaneously about their respective longitudinal axes, wherein each slat has a graphic pattern forming region on a base board of transparent material, said base board having, in a cross-section transverse to a longitudinal axis thereof, a central surface, a first bent surface bent obliquely upward from one edge of the central surface, and a second bent surface bent obliquely downward from the other edge, said graphic pattern forming regions of the respective slats are arranged to be combined with each other to produce a significant graphic pattern for an observer on the entire blind when the slats are angularly moved so that said central surface is oriented along a line-of-sight of the observer's eyes, each of said graphic pattern forming regions comprising a highlighted surface for blocking and strongly reflecting the light on at least a portion of at least one of the first and second bent surfaces of the base board, wherein each of said first and second bent surfaces comprise a transparent pouched double-wall portion with an open side end, and a graphic pattern piece having a shape corresponding to a graphic pattern forming region which is to be borne by each of said first and second bent surfaces, is removably inserted into a pouched-wall portion.

8. A blind according to claim 7, wherein said base board comprises a flattened tubular member.

9. A blind about their respective longitudinal axes, wherein each slat has a graphic pattern forming region on a base board of transparent material, said base board having, in a cross-section transverse to a longitudinal axis thereof, a central surface, a first bent surface bent obliquely upward from one edge of the central surface, and a second bent surface bent obliquely downward from the other edge, said graphic pattern forming regions of the respective slats are arranged to be combined with each other to produce a significant graphic pattern for an observer on the entire blind when the slats are angularly moved and titled to a predetermined angle which is significant for the observer eyes each of said graphic pattern forming regions comprising a highlighted surface for blocking and strongly reflecting the light on at least a portion of at least one of the first and second bent surfaces of the base board, wherein each of said first and second bent surfaces comprises a transparent pouched double-wall portion with an open side end, and an insert of a transparent base board having a graphic pattern forming region which is to be borne by each of said first and second bend surfaces, is removably inserted into the pouched double-wall portion transparent base board.

10. A blind according to claim 9, wherein said base board comprises a flattened tubular member.

11. A blind having parallel slats angularly movable simultaneously about their own longitudinal axes, wherein each slat has a graphic pattern forming region on a base board of transparent material, said base board having, in a cross-section transverse to the longitudinal axis thereof, a central surface, a first bent surface bent obliquely upward from one edge of the central surface, and a second bent surface bent obliquely downward from the other edge, the graphic pattern forming regions of the respective surfaces produce a significant graphic pattern for an observer when the slats are angularly moved and tilted to a predetermined angle, said second bent surface having a distal edge closer to a center than the junction between said central surface and said second bent surface.

12. A blind according to claim 11, wherein each of said first and second bent surfaces comprises a transparent pouched double-wall portion with an open side end, and a graphic pattern piece having a shape corresponding to a graphic pattern forming region which is to be borne by each of said first and second bent surfaces, is removably inserted into the pouched double-wall portion.

13. A blind according to claim 12, wherein said base board comprises a flattened tubular member.

14. A blind according to claim 11, wherein each of said first and second bent surfaces comprises a transparent pouched double-wall portion with an open side end, and an insert of a transparent base board having a graphic pattern forming region which is to be borne by each of said first and second bent surfaces, is removably inserted into the pouched double-wall portion transparent base board.

15. A blind according to claim 14, wherein said base board comprises a flattened tubular member.

16. A blind having parallel slats angularly movable simultaneously about their respective longitudinal axes, wherein each slat has opposite slat edges and a graphic pattern forming region on a base board of transparent material, said base board having, in a cross-section transverse to the longitudinal axis thereof, a central surface having two sides and two defining edges, a first bent surface projecting substantially perpendicularly from one side and along one defining edge of said central surface, and a second bent surface projecting substantially perpendicularly from the other side and along the other defining edge of said central surface, the graphic pattern forming regions comprising the respective bent surfaces which cooperate to produce a significant graphic pattern for an observer when the slats are angularly moved and tilted to a predetermined angle.

17. A blind according to claim 16, wherein each of said first and second bent surfaces comprises a transparent pouched double-wall portion with an open side end, and a graphic pattern piece having a shape corresponding to a graphic pattern forming region which is to be borne by each of said first and second bent surfaces, is removably inserted into the pouched double-wall portion.

18. A blind according to claim 17, wherein said base board comprises a flattened tubular member.

19. A blind according to claim 16, wherein each of said first and second bent surfaces comprises a transparent pouched double-wall portion with an open side end, and an insert of a transparent base board having a graphic pattern forming region which is to be borne by each of said first and second bent surfaces, is removably inserted into the pouched double-wall portion of transparent.

20. A blind according to claim 19, wherein said base board comprises a flattened tubular member.

21. A blind according to claim 1, wherein the significant graphic pattern is projected onto a floor or wall surface when the light coming from behind the blind is blocked by the graphic pattern forming regions.

22. A blind according to claim 1, wherein the significant graphic pattern is observed when the light coming from a front side of the blind is reflected by the graphic pattern forming regions.

* * * * *